US006241031B1

(12) United States Patent
Beaufort et al.

(10) Patent No.: US 6,241,031 B1
(45) Date of Patent: Jun. 5, 2001

(54) ELECTRO-HYDRAULICALLY CONTROLLED TRACTOR

(75) Inventors: Ronald E. Beaufort, Laguna Niguel; Norman Bruce Moore, Aliso Viejo; Duane Bloom, Anaheim, all of CA (US)

(73) Assignee: Western Well Tool, Inc., Anaheim, CA (US)

( * ) Notice: Subject to any disclaimer, the term of this patent is extended or adjusted under 35 U.S.C. 154(b) by 0 days.

(21) Appl. No.: 09/466,550

(22) Filed: Dec. 17, 1999

Related U.S. Application Data

(60) Provisional application No. 60/112,833, filed on Dec. 18, 1998.

(51) Int. Cl.[7] ..... E21B 4/04
(52) U.S. Cl. ..... 175/99; 175/51
(58) Field of Search ..... 175/51, 97, 98, 175/99, 104, 105; 299/31

(56) References Cited

U.S. PATENT DOCUMENTS

| | | | |
|---|---|---|---|
| Re. 28,449 | | 6/1975 | Edmond . |
| 2,167,194 | | 7/1939 | Anderson . |
| 2,271,005 | | 1/1942 | Grebe . |
| 2,946,565 | | 7/1960 | Williams . |
| 3,138,214 | | 6/1964 | Bridwell . |
| 3,180,436 | | 4/1965 | Kellner et al. . |
| 3,180,437 | | 4/1965 | Kellner et al. . |
| 3,185,225 | | 5/1965 | Ginies . |
| 3,224,513 | | 12/1965 | Weeden, Jr. . |
| 3,224,734 | * | 12/1965 | Hill ..... 254/134.6 |

(List continued on next page.)

FOREIGN PATENT DOCUMENTS

WO 94/27022 11/1994 (EP) .

0 257 744 B1 1/1995 (EP) .

OTHER PUBLICATIONS

"Kolibomac to Challenge Tradition." Norwegian Oil Review, 1988. pp. 50 & 52.

*Primary Examiner*—Thomas B. Will
*Assistant Examiner*—Meredith C. Petravick
(74) *Attorney, Agent, or Firm*—Knobbe, Martens, Olsen & Bear, LLP.

(57) ABSTRACT

A tractor for moving within a borehole comprises an elongated tractor body and two propulsion assemblies that are longitudinally movably engaged with the body. The tractor body has annular pistons configured to receive hydraulic thrust to propel the body longitudinally. Each propulsion assembly includes a gripper and one or more propulsion cylinders. The gripper has an actuated position in which the gripper limits relative movement between the gripper and the inner surface of the borehole, and a retracted position in which the gripper permits substantially free relative movement between the gripper and the inner surface of the borehole. Each propulsion cylinder contains one of the pistons. The tractor includes a control assembly having a plurality of valves and hydraulic circuitry which control the sequencing of fluid distribution to the propulsion cylinders, and of the actuation and retraction of the grippers. A throttle valve controls the fluid flowrate to the pistons. Load control valves permit limiting of the movement of the pistons relative to the grippers, by applying a fluid pressure force opposing longitudinal movement of each piston. A reverser valve controls the sequencing logic of the hydraulic circuitry, to allow tractor movement in either longitudinal direction. The throttle valve, load-control valves, and reverser valves are controlled by pilot pressures, which are in turn controlled by motor-operated valves. The motors can be controlled by electronic command signals, which permits the entire tractor to be controlled by electronic logic componentry on the tractor or at ground surface.

49 Claims, 8 Drawing Sheets

U.S. PATENT DOCUMENTS

| | | | | |
|---|---|---|---|---|
| 3,225,843 | | 12/1965 | Ortloff et al. . | |
| 3,376,942 | * | 4/1968 | Van Winkle | 175/99 |
| 3,497,019 | | 2/1970 | Ortloff . | |
| 3,599,712 | | 8/1971 | Magill . | |
| 3,606,924 | | 9/1971 | Malone . | |
| 3,797,589 | | 3/1974 | Kellner et al. . | |
| 3,827,512 | | 8/1974 | Edmond . | |
| 3,941,190 | | 3/1976 | Conover . | |
| 3,978,930 | | 9/1976 | Schroeder . | |
| 3,992,565 | | 11/1976 | Gatfield . | |
| 4,085,808 | | 4/1978 | Kling . | |
| 4,095,655 | | 6/1978 | Still . | |
| 4,141,414 | | 2/1979 | Johansson . | |
| 4,314,615 | | 2/1982 | Sodder, Jr. et al. . | |
| 4,365,676 | | 12/1982 | Boyadjieff et al. . | |
| 4,372,161 | * | 2/1983 | De Buda et al. | 73/432 R |
| 4,385,021 | | 5/1983 | Neeley . | |
| 4,440,239 | | 4/1984 | Evans . | |
| 4,463,814 | | 8/1984 | Horstmeyer et al. . | |
| 4,558,751 | | 12/1985 | Huffaker . | |
| 4,615,401 | | 10/1986 | Garrett . | |
| 4,674,914 | | 6/1987 | Wayman et al. . | |
| 4,686,653 | | 8/1987 | Staron et al. . | |
| 4,811,785 | | 3/1989 | Weber . | |
| 4,821,817 | | 4/1989 | Cendre et al. . | |
| 4,854,397 | | 8/1989 | Warren et al. . | |
| 4,951,760 | | 8/1990 | Cendre et al. . | |
| 5,010,965 | | 4/1991 | Schmelzer . | |
| 5,169,264 | | 12/1992 | Kimura . | |
| 5,184,676 | | 2/1993 | Graham et al. . | |
| 5,186,264 | | 2/1993 | de Chaffaut . | |
| 5,310,012 | | 5/1994 | Cendre et al. . | |
| 5,363,929 | | 11/1994 | Williams et al. . | |
| 5,425,429 | | 6/1995 | Thompson . | |
| 5,449,047 | | 9/1995 | Schivley, Jr. . | |
| 5,467,832 | | 11/1995 | Orban et al. . | |
| 5,519,668 | | 5/1996 | Montaron . | |
| 5,613,568 | * | 3/1997 | Sterner et al. | 175/99 |
| 5,752,572 | | 5/1998 | Baiden et al. . | |
| 5,758,731 | | 6/1998 | Zollinger . | |
| 5,758,732 | | 6/1998 | Liw . | |
| 5,794,703 | | 8/1998 | Newman et al. . | |
| 5,803,193 | | 9/1998 | Krueger et al. . | |
| 5,857,731 | | 1/1999 | Heim et al. . | |
| 6,003,606 | | 12/1999 | Moore et al. . | |
| 6,026,911 | | 2/2000 | Angle et al. . | |
| 6,031,371 | | 2/2000 | Smart . | |
| 6,082,461 | | 7/2000 | Newman et al. . | |
| 6,089,323 | | 7/2000 | Newman et al. . | |

* cited by examiner

ELECTRO-HYDRAULICALLY CONTROLLED TRACTOR

PRIORITY

This application claims priority to U.S. Provisional Patent Application No. 60/112,833, filed Dec. 18, 1998.

BACKGROUND

1. Field of the Invention

This invention relates generally to tractors for moving within boreholes, and specifically to a hydraulically powered tractor having electrically controlled motors that control tractor position, speed, thrust, and direction of travel by controlling fluid pressure acting on pressure-actuated valves.

2. Description of the Related Art

The art of drilling vertical, inclined, and horizontal boreholes plays an important role in many industries, such as the petroleum, mining, and communications industries. In the petroleum industry, for example, a typical oil well comprises a vertical borehole which is drilled by a rotary drill bit attached to the end of a drill string. The drill string is typically constructed of a series of connected links of drill pipe which extends between ground surface equipment and the drill bit. A drilling fluid, such as drilling mud, is pumped from the ground surface equipment through an interior flow channel of the drill string to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

The method described above is commonly termed "rotary drilling" or "conventional drilling." Rotary drilling often requires drilling numerous boreholes to recover oil, gas, and mineral deposits. For example, drilling for oil usually includes drilling a vertical borehole until the petroleum reservoir is reached, often at great depth. Oil is then pumped from the reservoir to the ground surface. Once the oil is completely recovered from a first reservoir, it is typically necessary to drill a new vertical borehole from the ground surface to recover oil from a second reservoir near the first one. Often a large number of vertical boreholes must be drilled within a small area to recover oil from a plurality of nearby reservoirs. This requires a large investment of time and resources.

In order to recover oil from a plurality of nearby reservoirs without incurring the costs of drilling a large number of vertical boreholes from the surface, it is desirable to drill inclined or horizontal boreholes. In particular, it is desirable to initially drill vertically downward to a predetermined depth, and then to drill at an inclined angle therefrom to reach a desired target location. This allows oil to be recovered from a plurality of nearby underground locations while minimizing drilling. In addition to oil recovery, boreholes with a horizontal component may also be used for a variety of other purposes, such as coal exploration and the construction of pipelines and communications lines.

Two methods of drilling vertical, inclined, and horizontal boreholes are the aforementioned rotary drilling and coiled tubing drilling. In rotary drilling, a rigid drill string, consisting of a series of connected segments of drill pipe, is lowered from the ground surface using surface equipment such as a derrick and draw works. Attached to the lower end of the drill string is a bottom hole assembly, which may comprise a drill bit, drill collars, stabilizers, sensors, and a steering device. In one mode of use, the upper end of the drill string is connected to a rotary table or top drive system located at the ground surface. The top drive system rotates the drill string, the bottom hole assembly, and the drill bit, allowing the rotating drill bit to penetrate into the formation. In a vertically drilled hole, the drill bit is forced into the formation by the weight of the drill string and the bottom hole assembly. The weight on the drill bit can be varied by controlling the amount of support provided by the derrick to the drill string. This allows, for example, drilling into different types of formations and controlling the rate at which the borehole is drilled.

The inclination of the rotary-drilled borehole can be gradually altered by using known equipment, such as a downhole motor with an adjustable bent housing to create inclined and horizontal boreholes. Downhole motors with bent housings allow the ground surface operator to change drill bit orientation, for example, with pressure pulses from the surface pump. Typical rates of change of inclination of the drill string are relatively small, approximately 3 degrees per 100 feet of borehole depth. Hence, the drill string inclination can change from vertical to horizontal over a vertical distance of about 3000 feet. The ability of the substantially rigid drill string to turn is often too limited to reach desired locations within the earth. In addition, friction of the drilling assembly on the casing or open hole frequently limits the distance that can be achieved with this drilling method.

As mentioned above, another type of drilling is coiled tubing drilling. In coiled tubing drilling, the drill string is a non-rigid, generally compliant tube. The tubing is fed into the borehole by an injector assembly at the ground surface. The coiled tubing drill string can have specially designed drill collars located proximate the drill bit that apply weight to the drill bit to penetrate the formation. The drill string is not rotated. Instead, a downhole motor provides rotation to the bit. Because the coiled tubing is not rotated or not normally used to force the drill bit into the formation, the strength and stiffness of the coiled tubing is typically much less than that of the drill pipe used in comparable rotary drilling. Thus, the thickness of the coiled tubing is generally less than the drill pipe thickness used in rotary drilling, and the coiled tubing generally cannot withstand the same rotational, compression, and tension forces in comparison to the drill pipe used in rotary drilling.

One advantage of coiled tubing drilling over rotary drilling is the potential for greater flexibility of the drilling assembly, to permit sharper turns to more easily reach desired locations within the earth. The capability of a drilling tool to turn from vertical to horizontal depends upon the tool's flexibility, strength, and the load which the tool is carrying. At higher loads, the tool has less capability to turn, due to friction between the borehole and the drill string and drilling assembly. Furthermore, as the angle of turning increases, it becomes more difficult to deliver weight on the drill bit. At loads of only 2000 pounds or less, existing coiled tubing tools, which are pushed through the hole by the gravity of weights, can turn as much as 90° per 100 feet of travel but are typically capable of horizontal travel of only 2500 feet or less. In comparison, at loads up to 3000 pounds, existing rotary drilling tools, whose drill strings are thicker and more rigid than coiled tubing, can only turn as much as 30°–40° per 100 feet of travel and are typically limited to horizontal distances of 5000–6000 feet. Again, such rotary tools are pushed through the hole by the gravity force of weights.

In both rotary and coiled tubing drilling, downhole tractors have been proposed to apply axial loads to the drill bit, bottom hole assembly, and drill string, and generally to move the entire drilling apparatus into and out of the borehole. The tractor may be designed to be secured between the lower end of the drill string and the upper end of the bottom hole assembly. The tractor may have anchors or grippers adapted to grip the borehole wall just proximal the drill bit. When the anchors grip the borehole, hydraulic power from the drilling fluid may be used to axially force the drill bit into the formation. The anchors may advantageously be slidably engaged with the tractor body, so that the drill bit, body, and drill string (collectively, the "drilling tool") can move axially into the formation while the anchors are gripping the borehole wall. The anchors serve to transmit axial and torsional loads from the tractor body to the borehole wall. One example of a downhole tractor is disclosed in allowed U.S. patent application Ser. No. 08/694,910 to Moore ("Moore '910"). Moore '910 teaches a highly effective tractor design as compared to existing alternatives.

It is known to have two or more sets of anchors (also referred to herein as "grippers") on the tractor, so that the tractor can move continuously within the borehole. For example, Moore '910 discloses a tractor having two grippers. Longitudinal (unless otherwise indicated, the terms "longitudinal" and "axial" are herein used interchangeably and refer to the longitudinal axis of the tractor body) motion is achieved by powering the drilling tool forward with respect to a first gripper which is actuated (a "power stroke"), and simultaneously moving a retracted second gripper forward with respect to the drilling tool ("resetting"), for a subsequent power stroke. At the completion of the power stroke, the second gripper is actuated and the first gripper is retracted. Then, the drilling tool is powered forward while the second gripper is actuated, and the retracted first gripper is simultaneously reset for a subsequent power stroke. Thus, each gripper is operated in a cycle of actuation, power stroke, retraction, and reset, resulting in longitudinal motion of the drilling tool.

The power required for actuating the anchors, axially thrusting the drilling tool, and axially resetting the anchors may be provided by the drilling fluid. For example, in the tractor disclosed by Moore '910, the grippers comprise inflatable engagement bladders. The Moore tractor uses hydraulic power from the drilling fluid to inflate and radially expand the bladders so that they grip the borehole walls. Hydraulic power is also used to power forward cylindrical pistons residing within propulsion cylinders slidably engaged with the tractor body. Each such cylinder is longitudinally fixed with respect to a bladder, and each piston is axially fixed with respect to the tractor body. When a bladder is inflated to grip the borehole, drilling fluid is directed to the proximal side of the piston in the cylinder that is secured to the inflated bladder, to power the piston forward with respect to the borehole. The forward hydraulic thrust on the piston results in forward thrust on the entire drilling tool. Further, hydraulic power is also used to reset each cylinder when its associated bladder is deflated, by directing drilling fluid to the distal side of the piston within the cylinder.

Tractors may employ a system of pressure-responsive valves for sequencing the distribution of hydraulic power to the tractor's anchors, thrust, and reset sections. For example, the Moore '910 tractor includes a number of pressure-responsive valves which shuttle between their various positions based upon the pressure of the drilling fluid in various locations of the tractor. In one configuration, a valve can be exposed on both sides to different fluid streams. The valve position depends on the relative pressures of the fluid streams. A higher pressure in a first stream exerts a greater force on the valve than a lower pressure in a second stream, forcing the valve to one extreme position. The valve moves to the other extreme position when the pressure in the second stream is greater than the pressure in the first stream. Another type of valve is spring-biased on one side and exposed to fluid on the other, so that the valve will be actuated against the spring only when the fluid pressure exceeds a threshold value. The Moore tractor uses both of these types of pressure-responsive valves.

It has also been proposed to use solenoid-controlled valves in tractors. In one configuration, solenoids electrically trigger the shuttling of the valves from one extreme position to another. Solenoid-controlled valves are not pressure-actuated. Instead, these valves are controlled by electrical signals sent from an electrical control system at the ground surface.

One limitation of prior art tractors is that they provide limited control over tractor position, speed, thrust capacity, and direction of travel. For example, while Moore '910 teaches a highly effective design, the tractor tends to travel at high speeds, except when under a large load. Thus, there is a need for a tractor which provides enhanced control over tractor position, speed, thrust, and direction of travel.

SUMMARY OF THE INVENTION

Accordingly, it is a principle advantage of the present invention to overcome some or all of these limitations and to provide an improved downhole drilling tractor.

The present invention provides a tractor configured to push and/or pull a bottom hole assembly and drill string through a borehole. The tractor is preferably used in conjunction with a coiled tubing drill system. Advantageously, the tractor is capable of moving long distances horizontally, and provides enhanced control over position, speed, thrust, and direction of travel, compared to prior art tractors. In particular, the tractor includes motors that control the position, speed, thrust, and direction of travel of the tractor. The motors can be electrically controlled by electronic command signals transmitted from logic componentry located at ground surface or on the tractor itself.

One goal of the present invention is to provide enhanced control over position and speed of the tractor. Accordingly, the present invention provides a tractor having a throttle valve and load control valves, which provide varying degrees of control over tractor speed and position. Desirably, the throttle valve provides relatively rougher control, and the load-control valves provide relatively finer control. The throttle valve and load-control valves can be controlled by electronic command signals transmitted by electronic logic componentry on the tractor or at ground surface.

In one aspect, the present invention provides a tractor for moving within a borehole, comprising an elongated body, a gripper longitudinally movably engaged with the body, a flow channel, a chamber, and a pressure-regulator. The elongated body has at least one thrust-receiving portion, such as an annular piston. The gripper has an actuated position in which the gripper limits relative movement between the gripper and an inner surface of said borehole, and a retracted position in which the gripper permits substantially free relative movement between the gripper and the inner surface of the borehole. The flow channel extends to the thrust-receiving portion of the body and is configured to contain a first fluid flowing to the thrust-receiving portion. The chamber is configured to contain a second fluid. The pressure-regulator is configured to control the pressure of the second fluid in the chamber. The tractor is configured such that the pressure of the second fluid in the chamber controls the flowrate of the first fluid in the flow channel, as the first fluid flows to the thrust-receiving portion.

In one embodiment, the pressure-regulator comprises first and second valve portions. The second valve portion has a closed position and an open position. In the closed position, the second valve portion mates with the first valve portion to prevent the second fluid from flowing out of the chamber. In the open position, the second valve portion permits the second fluid to flow out of the chamber between the first valve portion and the second valve portion. The second valve portion is biased to its closed position by a closing force that is controllable to control the pressure of the second fluid inside the chamber. In another embodiment, the pressure-regulator further comprises a biasing means providing the closing force. In another embodiment, the first valve portion comprises an orifice in fluid communication with the chamber, and the second valve portion comprises a plug sized and configured to seal the orifice. In yet another embodiment, the biasing means comprises a spring. Also, a controller, such as a motor, is provided to control the closing force. The motor is configured to be controlled by electronic command signals.

In another aspect of the present invention, the size of a portion of the flow channel can be altered to control the thrust received by the thrust-receiving portion from the first fluid. This is due to the fact that as the size of the flow channel increases, so does the volume flowrate of the first fluid. In another aspect of the invention, the tractor further comprises a first valve movable to vary the size of the portion of the flow channel, wherein the thrust received by the thrust-receiving portion is controllable by moving the first valve. In another aspect, the first valve has a first position in which the flow channel is closed, and a second position in which the portion of the flow channel has a maximum size. The valve is movable so that the flow channel can have multiple sustainable sizes greater than zero. In another aspect, the tractor further comprises an additional biasing means, such as a spring, which exerts a spring force onto the first valve. The spring force tends to push the first valve to its first position, and increases as the first valve moves toward the second position. The first valve is in fluid communication with the chamber configured to contain the second fluid, so that the first valve is configured to receive a pressure force from the second fluid. The pressure force opposes the spring force and tends to force the first valve toward its second position. Desirably, the position of the first valve is controllable by controlling the pressure of the second fluid in the chamber.

In another aspect, the present invention provides a tractor for moving within a borehole, comprising an elongated body and a gripper longitudinally movably engaged with the body. The elongated body has a thrust-receiving portion, such as an annular piston. The gripper has an actuated position in which the gripper limits relative movement between the gripper and an inner surface of the borehole, and a retracted position in which the gripper permits substantially free relative movement between the gripper and the inner surface of the borehole. The tractor is configured such that longitudinal movement of the thrust-receiving portion in a first direction relative to the gripper can be opposed by a fluid pressure force. The fluid pressure force is controllable to at least partially control the position and speed of the thrust-receiving portion relative to the gripper.

In another aspect, the present invention provides a tractor for moving within a borehole, comprising an elongated body, a gripper longitudinally movably engaged with the body, a container longitudinally fixed with respect to the gripper and longitudinally movable with respect to the body, and a first valve. The elongated body has a thrust-receiving portion, such as a cylindrical piston. The gripper has an actuated position in which the gripper limits relative movement between the gripper and an inner surface of the borehole, and a retracted position in which the gripper permits substantially free relative movement between the gripper and the inner surface. The container contains the thrust-receiving portion. The first valve is configured to prevent a first fluid on a first side of the thrust-receiving portion from being displaced by the thrust-receiving portion when the first fluid is below a threshold pressure.

In one embodiment, the above-mentioned threshold pressure can be varied. Advantageously, the tractor further comprises a second valve configured to regulate the pressure of a second fluid exerting a pressure force on the first valve, wherein the threshold pressure can be controlled by controlling the second valve.

In another embodiment, the tractor further comprises a chamber configured to contain a second fluid, and a pressure-regulator controllable to control the pressure of the second fluid in the chamber. In yet another embodiment, the first valve comprises a first orifice and a flow-restrictor. The first orifice is configured to be in fluid communication with the container. The flow-restrictor has a first surface in fluid communication with the first side of the thrust-receiving portion, and a second surface in fluid communication with the chamber. The second surface generally opposes the first surface. The flow-restrictor has a closed position in which the flow-restrictor completely restricts fluid flow through the first orifice, and an open position in which the flow-restrictor permits fluid flow through the first orifice. The first surface of the flow-restrictor is configured to receive a first pressure force from the first fluid, the first pressure force tending to move the flow-restrictor to its open position. The second surface of the flow-restrictor is configured to receive a second pressure force from the second fluid, the second pressure force tending to move the flow-restrictor to its closed position.

In another embodiment, the flow-restrictor is biased toward its closed position by a biasing force and is configured to move toward its open position when the first pressure force exceeds the sum of the biasing force and the second pressure force. In another embodiment, the first valve further comprises a biasing means providing the biasing force.

In another embodiment, the pressure-regulator comprises a second orifice, a plug, and a spring. The second orifice is in fluid communication with the chamber. The plug has a closed position in which the plug prevents the second fluid from flowing out of the chamber through the second orifice, and an open position in which the plug permits the second fluid to flow out of the chamber through the second orifice. The spring exerts a closing force onto the plug which tends to maintain the plug in its closed position. Desirably, the closing force is controllable to control the pressure of the second fluid inside the chamber. In yet another embodiment, the second valve further comprises a motor controlling one of compression or extension of the spring so as to control the closing force. The motor is configured to be controlled by electronic command signals.

Another goal of the invention is to provide greater control over the direction of travel of the tractor. Accordingly, the present invention provides a tractor comprising an elongated body, a gripper substantially as described above, a fluid distribution system, a reverser valve, and a motor. The body has a thrust-receiving portion having a first surface configured to receive hydraulic thrust to propel the body in a first longitudinal direction, and a second surface configured to receive hydraulic thrust to propel the body in a second longitudinal direction generally opposite the first direction. The fluid distribution system is configured to provide hydraulic thrust to the first and second surfaces. The reverser valve has a first position in which the distribution system provides hydraulic thrust to the first surface, and a second position in which the distribution system provides hydraulic thrust to the second surface. The motor is configured to control the position of the reverser valve.

In one embodiment, the reverser valve is biased into its first position, and the tractor further comprises a chamber and a pressure-regulator. The chamber is in fluid communication with a surface of the reverser valve, and is configured to contain a first fluid. The pressure-regulator is configured to control the pressure of the first fluid in the chamber. In use, the pressure of the first fluid opposes the bias of the reverser valve. Advantageously, the motor controls the pressure-regulator. In yet another embodiment, the pressure-regulator comprises a pilot valve having a first position and a second position. In the first position, the pilot valve is configured to permit higher pressure fluid into the chamber, wherein the higher pressure fluid is configured to exert a pressure force onto the surface of the reverser valve to push the reverser valve to its second position. In the second position, the pilot valve permits the first fluid to flow out of the chamber so that the bias maintains the reverser valve in the first position. Advantageously, the motor controls the position of the pilot valve.

In another aspect, the present invention provides a tractor for moving within a borehole, comprising an elongated body, a first gripper, a second gripper, a first elongated container, a second elongated container, a fluid distribution system, a reverser valve, and a motor. The body has first and second thrust-receiving portions on an outer surface of the body. Each gripper is longitudinally movably engaged with the body and has an actuated position in which the gripper limits relative movement between the gripper and an inner surface of the borehole, and a retracted position in which the gripper permits substantially free relative movement between the gripper and the inner surface. The first container is longitudinally movably engaged on the body and longitudinally fixed with respect to the first gripper. The first container defines a first elongated space between the first container and the body, and encloses the first thrust-receiving portion such that the first thrust-receiving portion fluidly divides the first space into a first chamber and a second chamber. Similarly, the second container is longitudinally movably engaged on the body and longitudinally fixed with respect to the second gripper. The second container defines a second elongated space between the second container and the body, and encloses the second thrust-receiving portion such that the second thrust-receiving portion fluidly divides the second space into a third chamber and a fourth chamber.

The fluid distribution system is configured to distribute fluid to the first, second, third, and fourth chambers to propel the body longitudinally. The reverser valve is configured to control the direction of the tractor. The reverser valve has a first position in which the tractor moves in a first longitudinal direction according to a first cycle of steps comprising: actuating the first gripper; retracting the second gripper; supplying fluid to the first chamber to propel the body in the first direction; supplying fluid to the fourth chamber to propel the second container in the first direction, the second container being propelled with respect to the body; actuating the second gripper; retracting the first gripper; supplying fluid to the third chamber to propel the body in the first direction; and supplying fluid to the second chamber to propel the first container in the first direction, the first container being propelled with respect to the body.

The reverser valve also has a second position in which the tractor moves in a second longitudinal direction according to a second cycle of steps comprising: actuating the first gripper; retracting the second gripper; supplying fluid to the second chamber to propel the body in the second direction which is generally opposite the first direction; supplying fluid to the third chamber to propel the second container in the second direction, the second container being propelled with respect to the body; actuating the second gripper; retracting the first gripper; supplying fluid to the fourth chamber to propel the body in the second direction; and supplying fluid to the first chamber to propel the first container in the first direction, the first container being propelled with respect to the body. Advantageously, the motor is configured to control the position of the reverser valve.

Yet another goal of the present invention is to provide a tractor in which the grippers are inflatable, and in which the deflation rates can be finely controlled to facilitate faster subsequent inflation and, hence, tractor speed. Accordingly, in one embodiment at least one gripper is inflatable to move to its actuated position and deflatable to move to its retracted position. The tractor further comprises a gripper control valve configured to define a first flow orifice and a second flow orifice. The gripper control valve has a first position in which fluid is configured to flow through the first flow orifice to the gripper to inflate the gripper to its actuated position, and a second position in which fluid is configured to flow from the gripper through the second flow orifice to deflate the gripper to its retracted position. Advantageously, the gripper control valve is configured to vary the size of the second flow orifice so that the deflation rate can be finely controlled.

Yet another goal of the present invention is to provide a tractor in which the timing of the power strokes and reset strokes can be more precisely controlled. Accordingly, the present invention provides a tractor for moving within a borehole, comprising an elongated body, a gripper, first and second valves, and first, second, third, and fourth fluid chambers. The body has a thrust-receiving portion having a first surface and a second surface generally opposing the first surface. The gripper is longitudinally movably engaged with the body, and has an actuated position in which the gripper limits relative movement between the gripper and an inner surface of the borehole, and a retracted position in which the gripper permits substantially free relative movement between the gripper and the inner surface.

The first valve has a first position in which the first valve directs fluid to the first surface of the thrust-receiving portion, and a second position in which the first valve directs fluid to the second surface of the thrust-receiving portion. The first valve has a first end surface configured to receive a first fluid pressure force acting to push the first valve to the first position of the first valve. The first valve is configured to receive a first opposing force opposing the first fluid pressure force. The second valve has a first position in which the second valve permits fluid communication between the first chamber and the first end surface, and a second position in which the second valve permits fluid communication between the second chamber and the first end surface. The second valve has a second end surface in fluid communication with the third chamber, and is configured to receive a second fluid pressure force acting to push the second valve to the first position of the second valve. The second valve also has a third end surface in fluid communication with the fourth chamber. The third end surface is configured to receive a third fluid pressure force opposing the second fluid pressure force. Pressure variations in the first, second, and third chambers cause the first and second valves to cycle between their first and second positions. Advantageously, the fluid pressure in the fourth chamber is controllable to control the movement of the second valve.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1A:
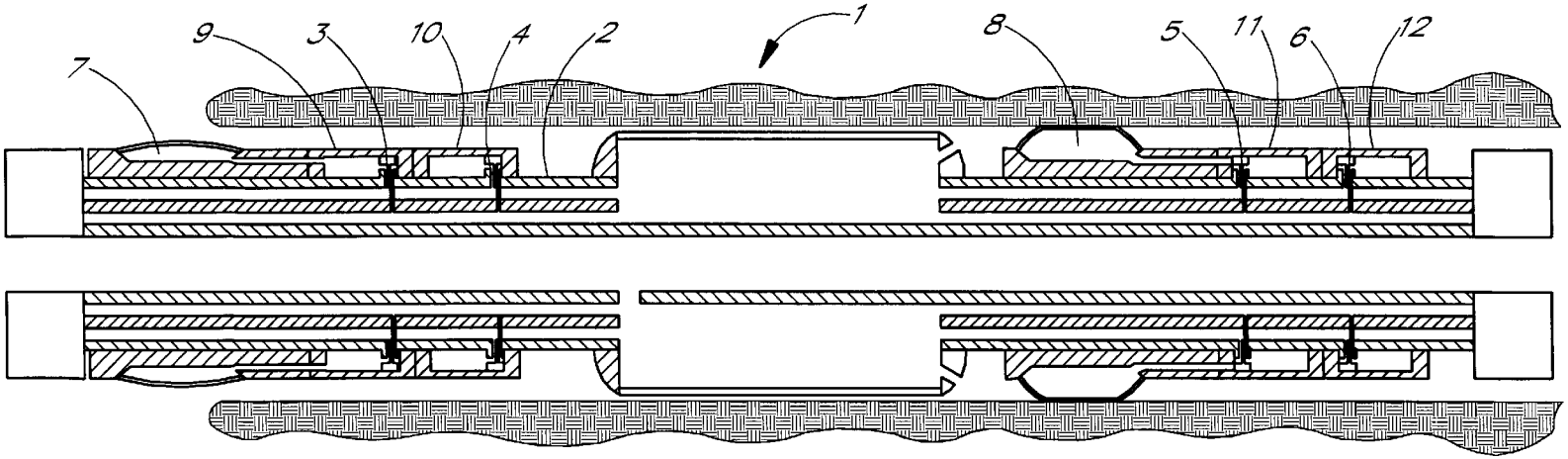
FIG. 1A (PRIOR ART)
FIGS. 1A–E are schematic diagrams of a prior art tractor, illustrating a method by which the tractor moves within a borehole.

This application hereby incorporates by reference the following U.S. patent applications in their entirety: (1) U.S. patent application Ser. No. 08/694,910 to Moore, entitled "Puller-Thruster Downhole Tool," filed Aug. 9, 1996; (2) U.S. Provisional Patent Application No. 60/112,833 to Moore, et al., entitled "Smart Tractor," filed Dec. 18, 1998; and (3) a U.S. patent application entitled "Electrically Sequenced Tractor," filed Dec. 3, 1999, in its entirety. The latter application discloses an electrically sequenced tractor (EST) which permits extremely precise control over position, speed, thrust, and direction of travel. However, the tractor of the present invention is believed to be less expensive to manufacture, and is thus more desirable for certain applications, such as walking and moving equipment within a borehole.

FIGS. 1A–E show a prior art tractor 1 configured to move within a borehole. Tractor 1 includes an elongated body 2 having cylindrical pistons 3, 4, 5, and 6 which are fixed to body 2 and are configured to receive hydraulic thrust to propel body 2 longitudinally within the borehole. Pistons 3, 4, 5, and 6 reside within propulsion cylinders 9, 10, 11, and 12, respectively. An aft gripper 7 and a forward gripper 8 are longitudinally movably engaged with body 2, and are configured to grip onto the inner surface of the borehole. In the illustrated tractor, grippers 7 and 8 are inflatable bladders. Gripper 7 is fixed with respect to propulsion cyinders 9 and 10, and gripper 8 is fixed with respect to propulsion cylinders 11 and 12.

Figure 1B:
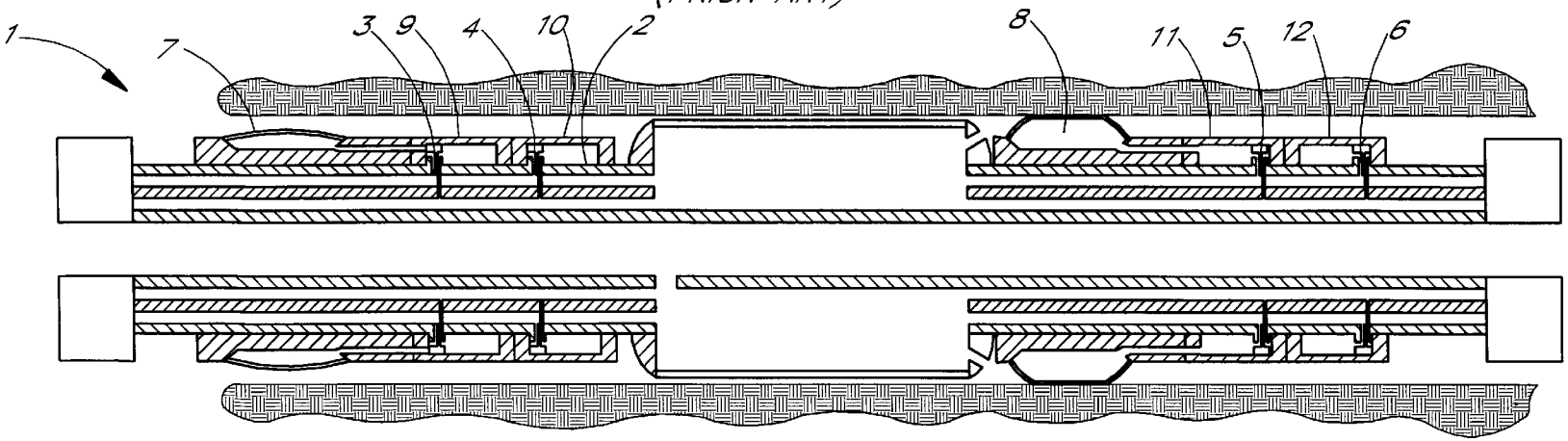
FIG. 1B (PRIOR ART)
Figure 1C:
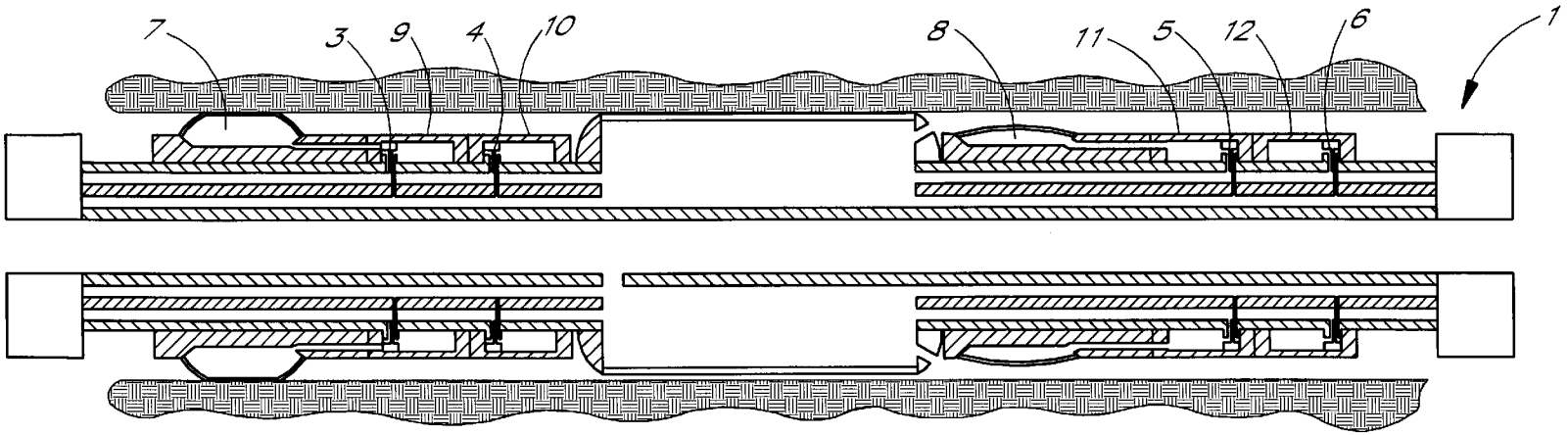
FIG. 1C (PRIOR ART)
Figure 1D:
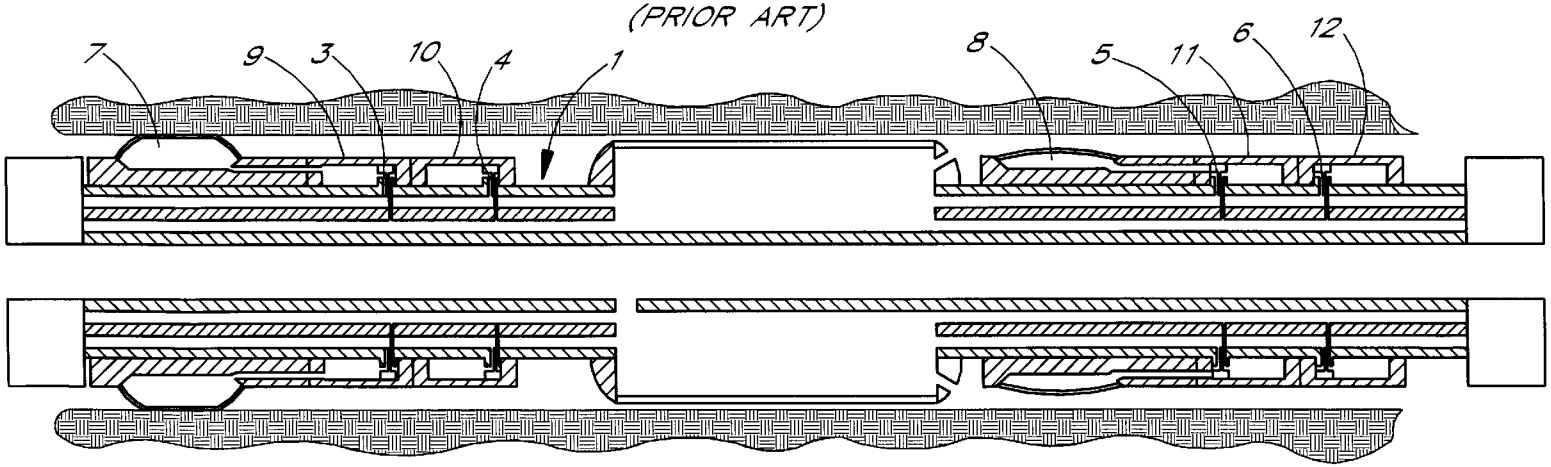
FIG. 1D (PRIOR ART)
Figure 1E:
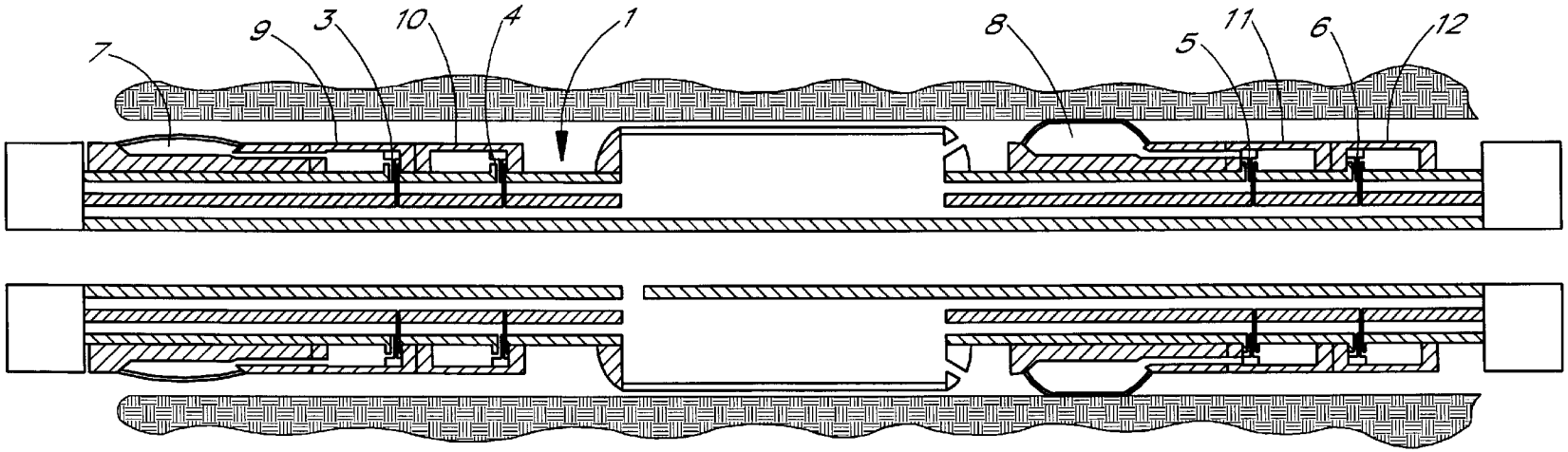
FIG. 1E (PRIOR ART)

FIGS. 1A–E illustrate how tractor 1 moves within a borehole. In particular, the figures show tractor 1 moving from left to right. However, it is clear to those skilled in the art that the tractor can move in the opposite direction according to the same principles. In FIG. 1A, aft gripper 7 is retracted and forward gripper 8 is actuated. Propulsion cylinders 9 and 10 are positioned to perform a reset stroke, and pistons 5 and 6 are positioned to perform a power stroke. Fluid is supplied to the forward sides of pistons 3 and 4, causing cylinders 9 and 10 and gripper 7 to slide forward with respect to body 2 and the borehole, as shown in FIG. 1B. This is referred to herein as a reset stroke. Simultaneously, fluid is supplied to the aft sides of pistons 5 and 6, causing pistons 5 and 6 to slide forward within cylinders 11 and 12, as shown in FIG. 1B. This is referred to herein as a power stroke, since the forward motion of pistons 5 and 6 propels body 2 forward. Then, fluid is supplied to aft gripper 7 and released from forward gripper 8. As shown in FIG. 1C, this causes aft gripper 7 to grip onto the borehole, while forward gripper 8 releases its grip. Then, fluid is supplied to the aft sides of pistons 3 and 4 and to the forward sides of pistons 5 and 6. This causes pistons 3 and 4 to perform a power stroke and cylinders 11 and 12 to perform a reset stroke, as shown in FIG. 1D. Then, as shown in FIG. 1E, forward gripper 8 is inflated and aft gripper 7 is deflated. At this point tractor 1 is in the same configuration as in FIG. 1A. The cycle is then repeated.

Figure 2:
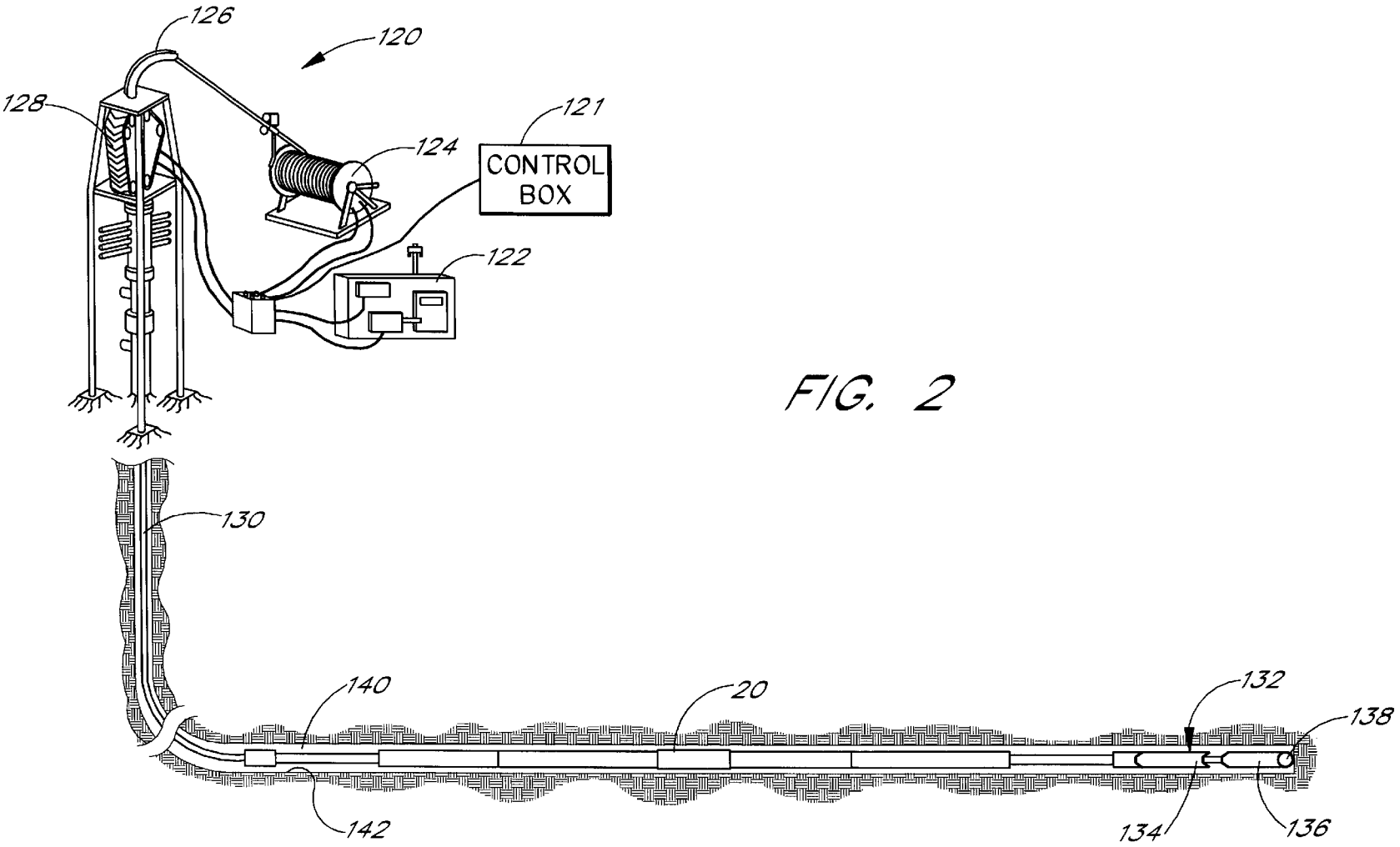
FIG. 2 is a schematic diagram of the major components of one embodiment of a coiled tubing drilling system of the present invention.

FIG. 2 shows a tractor 20 for moving equipment within a passage, configured in accordance with a preferred embodiment of the present invention. In the embodiments shown in the accompanying figures, the tractor of the present invention may be used in conjunction with a coiled tubing drilling system 120 and a bottom hole assembly 132. System 120 may include a control box 121, power supply 122, tubing reel 124, tubing guide 126, tubing injector 128, and coiled tubing 130, all of which are well known in the art. Assembly 132 may include a measurement while drilling (MWD) system 134, downhole motor 136, and drill bit 138, all of which are also known in the art. The tractor 20 is configured to move within a borehole having an inner surface 142. An annulus 140 is defined by the space between the tractor and the inner surface 142.

Control box 121 is electrically connected to various controllers included within tractor 20, as described below. Box 121 is configured to transmit electronic command signals that control the motion of tractor 20. Box 121 may comprise, for example, a programmable logic device, EPROM, or other electrical logic unit. Alternatively, a control box, such as a programmable logic device, EPROM, or other electrical logic unit, may be provided on the tractor body within a pressure-compensated housing. The electrical components are preferably housed in a pressure-compensated environment to allow operation to 16,000 psi downhole pressure. Electrical inputs for other downhole sensors (such as a weight on bit electrical output, pressure drop from downhole tool, tension sub located above the tool, or other electrical sensor that may be desirable to control the tool). The tool may be controlled by a performance algorithm embodied in the electronic logic.

It will be appreciated that the tractor of the present invention may be used to move a wide variety of tools and equipment within a borehole. Also, the present invention can be used in conjunction with numerous types of drilling, including rotary drilling and the like. Additionally, it will be understood that the present invention may be used in many areas including petroleum drilling, mineral deposit drilling, pipeline installation and maintenance, communications, and the like. Also, it will be understood that the apparatus and method for moving equipment within a passage may be used in many applications in addition to drilling. For example, these other applications include well completion and production work for producing oil from an oil well, pipeline work, and communications activities. It will be appreciated that these applications may require the use of other equipment in conjunction with an drilling tool according to the present invention. Such equipment, generally referred to as a working unit, is dependent upon the specific application undertaken.

For example, one of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. These completion activities can be accomplished in inclined and horizontal boreholes using a preferred embodiment of the present invention. For instance, the tractor of the present invention can deliver these various types of logging sensors to regions of interest. The tractor can either place the sensors in the desired location, or the tractor may idle in a stationary position to allow the measurements to be taken at the desired locations. The tractor can also be used to retrieve the sensors from the well.

Examples of production work that can be performed with a preferred embodiment of the present invention include sands and solids washing and acidizing. It is known that wells sometimes become clogged with sand, hydrocarbon debris, and other solids that prevent the free flow of oil through the borehole. To remove this debris, specially designed washing tools known in the industry are delivered to the region, and fluid is injected to wash the region. The fluid and debris then return to the surface. Such tools include acid washing tools. These washing tools can be delivered to the region of interest for performance of washing activity and then returned to the ground surface by a preferred embodiment of the present invention.

In another example, a preferred embodiment of the present invention can be used to retrieve objects, such as damaged equipment and debris, from the borehole. For example, equipment may become separated from the drill string, or objects may fall into the borehole. These objects must be retrieved, or the borehole must be abandoned and plugged. Because abandonment and plugging of a borehole is very expensive, retrieval of the object is usually attempted. A variety of retrieval tools known to the industry are available to capture these lost objects. The present invention can be used to transport retrieving tools to the appropriate location, retrieve the object, and return the retrieved object to the surface.

In yet another example, a preferred embodiment of the present invention can also be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The present invention can be used in conjunction with the deployment of conventional velocity string and simple primary production tubing installations. The present invention can also be used with the deployment of artificial lift devices such as gas lift and downhole flow control devices.

In a further example, a preferred embodiment of the present invention can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the tractor of the present invention so that the cleaning tools can be moved within the pipeline.

In still another example, a preferred embodiment of the present invention can be used to move communication lines or equipment within a passage. Frequently, it is desirable to run or move various types of cables or communication lines through various types of conduits. The tractor of the present invention can move these cables to the desired location within a passage.

Figure 3A:
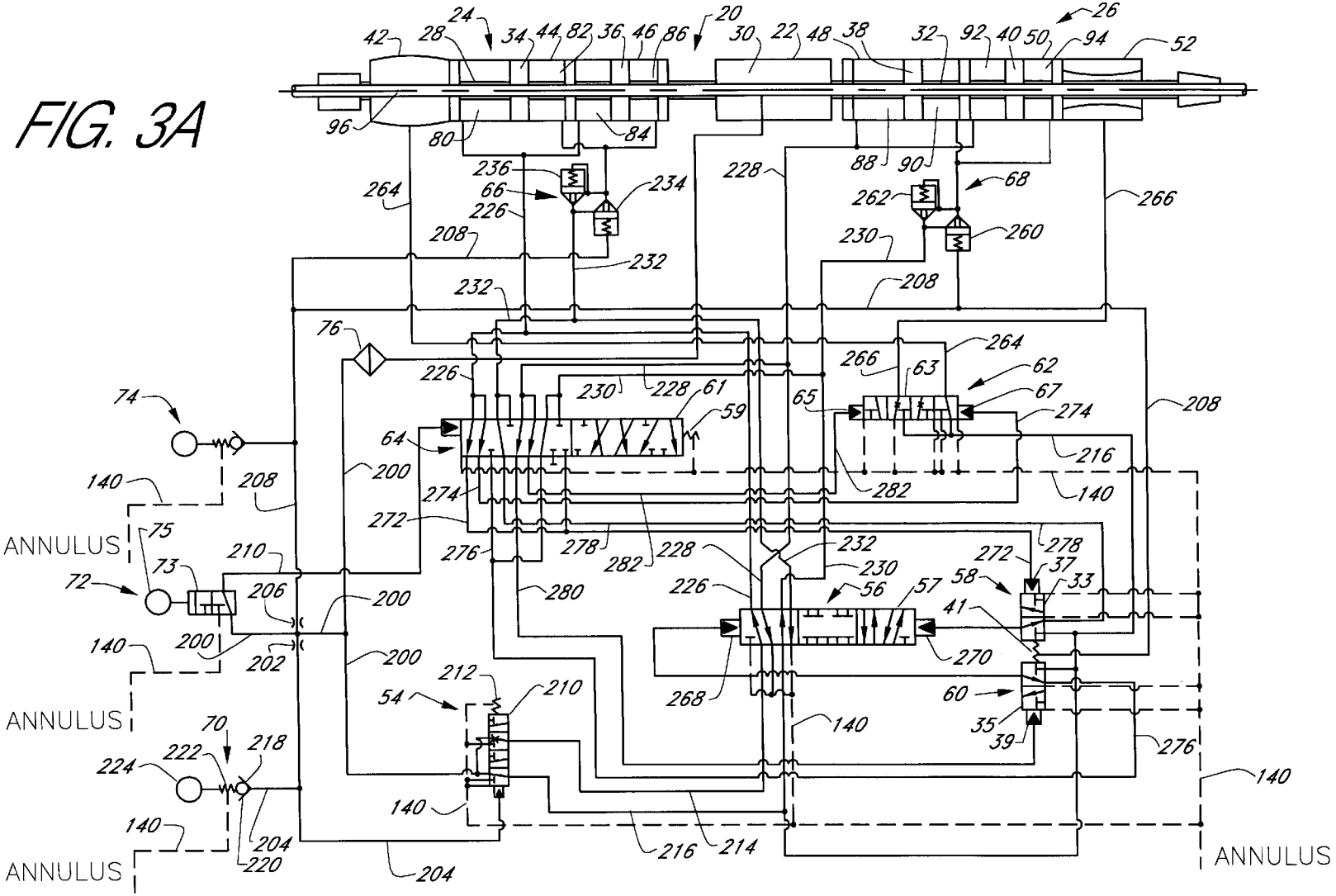
FIG. 3A is a schematic diagram of the control assembly of the tractor of the present invention.
Figure 3C:
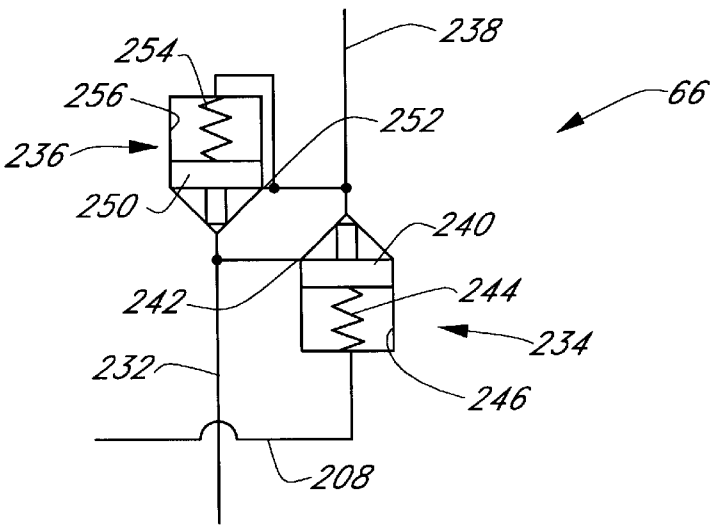
FIG. 3C is an exploded view of one of the load-control valves of FIG. 3A.
Figure 3B:
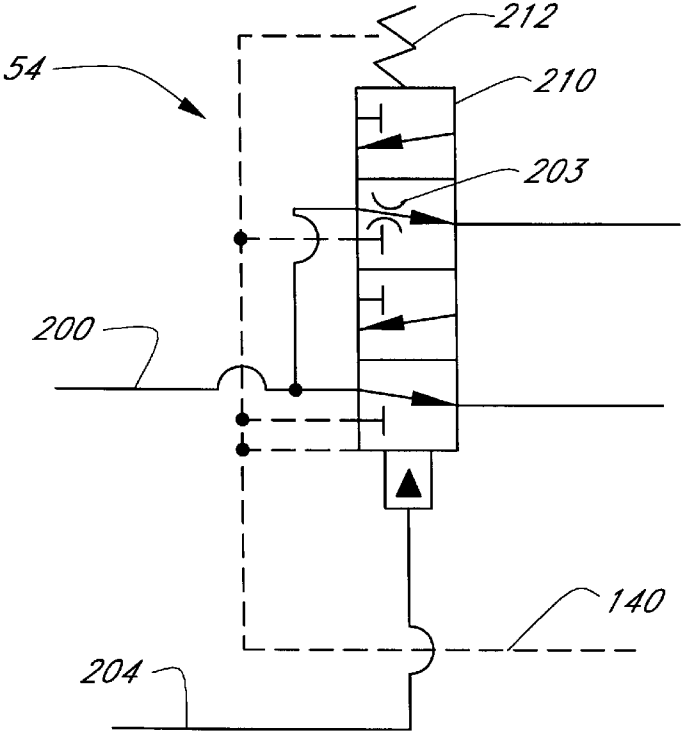
FIG. 3B is an exploded view of the throttle valve of FIG. 3A.

FIGS. 3A–C schematically illustrate one embodiment of the tractor 20 according to the present invention. Those of ordinary skill in the art will understand the manner by which tractor 20 moves within a borehole from FIGS. 3A–C. However, prior art FIGS. 1A–E have been added to facilitate faster understanding by those not of skill in the art.

Tractor 20 comprises an elongated tractor body 22 and propulsion assemblies 24 and 26. Tractor body 22 is sized and shaped to move within a borehole and is preferably generally cylindrical in cross-section. In the illustrated embodiment, tractor body 22 comprises a first or aft shaft 28, control assembly 30, and a second or forward shaft 32 connected end-to-end. Shafts 28 and 32 and control assembly 30 include longitudinal bores which collectively form a passage 96 configured to contain drilling fluid flowing from the coiled tubing through tractor 20. Shafts 28 and 32 and assembly 30 are preferably cylindrical. Body 22 also includes one or more thrust-receiving portions, such as cylindrical pistons 34, 36, 38, and 40, which are fixed to the shafts. The pistons are configured to receive hydraulic thrust from a fluid inside tractor 20 to power body 22 downhole or uphole in a manner described below. In particular, the aft surfaces of the pistons are configured to receive hydraulic thrust to power body 22 downhole, and the forward surfaces of the pistons are configured to receive hydraulic thrust to power body 22 uphole.

Propulsion assemblies 24 and 26 each comprise a gripper and one or more containers which are longitudinally movably engaged with body 22. Aft propulsion assembly 24 comprises a first or aft gripper 42 and one or more containers, such as propulsion cylinders 44 and 46 in the illustrated embodiment. Aft gripper 42 and cylinders 44 and 46 are longitudinally movably engaged with aft shaft 28. Preferably, gripper 42 and cylinders 44 and 46 are connected end-to-end so that they are longitudinally fixed with respect to each other. Cylinders 44 and 46 contain pistons 34 and 36, respectively. Similarly, forward propulsion assembly 26 comprises a second or forward gripper 52 and one or more containers, such as propulsion cylinders 48 and 50 in the illustrated embodiment. Forward gripper 52 and cylinders 48 and 50 are longitudinally movably engaged with forward shaft 32. Preferably, gripper 52 and cylinders 48 and 50 are connected end-to-end so that they are longitudinally fixed with respect to each other. Cylinders 48 and 50 contain pistons 38 and 40, respectively. Although two aft propulsion cylinders and two forward propulsion cylinders are shown in the illustrated embodiment, any number of cylinders may be provided, which includes only a single aft cylinder and a single forward cylinder. Note that the thrust capability of the tractor increases with the number of cylinders and associated thrust-receiving portions.

In the illustrated embodiment, propulsion cylinders 44, 46, 48, and 50 engage tractor body 22 so as to form annular chambers surrounding shafts 28 and 32. Pistons 34, 36, 38, and 40 reside within and divide such annular chambers into aft chambers and forward chambers which are desirably fluidly sealed from one another by the pistons. Moreover, the pistons are desirably configured to slide longitudinally within said cylinders so as to maintain a fluid seal between the aft and forward chambers inside the cylinders. For instance, piston 34 resides within cylinder 44 and fluidly divides the interior of cylinder 44 into an aft chamber 80 and a forward chamber 82. As piston 34 slides longitudinally, aft chamber 80 and forward chamber 82 remain fluidly sealed from each other. Similarly, piston 36 divides the interior of cylinder 46 into an aft chamber 84 and a forward chamber 86, piston 38 divides the interior of cylinder 48 into an aft chamber 88 and a forward chamber 90, and piston 40 divides the interior of cylinder 50 into an aft chamber 92 and a forward chamber 94.

Grippers 42 and 52 may comprise any of a variety of anchoring devices. Desirably, grippers 42 and 52 comprise inflatable engagement bladder-type packerfeet. When tractor 20 is in a borehole, the grippers are operable to grip against the inner surface of the borehole. Each gripper has an actuated position in which the gripper limits relative movement between the gripper and the inner surface of the borehole, and a retracted position in which the gripper permits substantially free relative movement between the gripper and the inner surface of the borehole. In the illustrated embodiment, the grippers include engagement bladders which may be inflated to grip onto the borehole. In the actuated position, each gripper prevents relative longitudinal movement between its associated propulsion cylinders and the inner surface of the borehole. For example, when gripper 42 is actuated, propulsion cylinders 44 and 46 are prevented from moving longitudinally with respect to the borehole wall.

Tractor 20 is configured to move within a borehole according to the following cycle: First, aft gripper 42 is inflated and forward gripper 52 deflated, thus preventing longitudinal motion of cylinders 44 and 46 with respect to the borehole and permitting motion of cylinders 48 and 50 with respect to the borehole. Fluid is then supplied to aft chambers 80 and 84 of cylinders 44 and 46. This causes pistons 34 and 36 to move toward the forward or downhole ends of cylinders 44 and 46 due to the volume of incoming fluid. This is referred to herein as a power stroke, since the motion of the pistons powers tractor body 22 downhole through the borehole. As pistons 34 and 36 perform a power stroke, fluid is simultaneously supplied to forward chambers 90 and 94 of cylinders 48 and 50. Since forward gripper 52 is deflated, the volume of incoming fluid causes cylinders 48 and 50 to move forward with respect to body 22, so that pistons 38 and 40 approach the aft ends of cylinders 48 and 50. This is referred to herein as a reset stroke, since cylinders 48 and 50 are reset for a subsequent power stroke of pistons 38 and 40. Next, forward gripper 52 is inflated and aft gripper 42 is thereafter deflated. Then, fluid is supplied to aft chambers 88 and 92, causing pistons 38 and 40 to execute a power stroke. Simultaneously, fluid is supplied to forward chambers 82 and 86, causing cylinders 44 and 46 to execute a reset stroke. The cycle is then repeated.

Control assembly 30 includes a plurality of valves and motors operable to distribute fluid throughout tractor 20. In the illustrated embodiment, assembly 30 includes throttle valve 54, propulsion-control valve 56, aft cycle valve 58, forward cycle valve 60, gripper-control valve 62, reverser valve 64, aft load-control valve 66, forward load-control valve 68, throttle pressure-regulator 70, reverser pilot valve 72, load-control pressure-regulator 74, and filter 76.

Tractor 20 is hydraulically powered by a fluid such as drilling mud or hydraulic fluid. Unless otherwise indicated, the terms "fluid" and "drilling fluid" are used interchangeably hereinafter. In a preferred embodiment, tractor 20 is powered by the same fluid which lubricates and cools the drill bit. Preferably, drilling mud is used in an open system. This avoids the need to provide additional fluid channels in the tool for the fluid powering tractor 20. Alternatively, hydraulic fluid may be used in a closed system, if desired.

Referring to FIGS. 2 and 3A, in operation, drilling fluid flows from the drill string 130 through passage 96 of tractor 20 and down to drill bit 138. A diverter diverts a portion of the drilling fluid from passage 96 to control assembly 30, to provide hydraulic power for moving tractor 20 within the borehole. Preferably, the diverter includes a filter 76 which removes larger fluid particles that can damage internal components of the control assembly, such as the valves. Any of a variety of known types of filters can be used. Fluid exiting filter 76 enters chamber 200, shown in FIG. 3A as a set of connected fluid lines. The term "chamber" herein refers to a volume of any size and shape, such as, for example, one or more connected tubular fluid passages. Chamber 200 extends to throttle valve 54 and to reverser pilot valve 72. A chamber 204 is in fluid communication with chamber 200 through a flow-restriction 202. Similarly, a chamber 208 is in fluid communication with chamber 200 through a flow-restriction 206. Flow-restrictions 202 and 206 permit chambers 200, 204, and 208 to simultaneously have different operating fluid pressures. Chamber 204 extends to and communicates with throttle pressure-regulator 70 and throttle valve 54 in a manner described below. Chamber 208 extends to load-control pressure-regulator 74, load valves 66 and 68, and cycle valves 58 and 60 in a manner described below.

Referring to FIGS. 3A and 3B, throttle valve 54 controls the flowrate of fluid to the thrust-receiving pistons 34, 36, 38, and 40. Throttle valve 54 is designed to permit fluid to flow from chamber 200 to chambers 214 and 216 of the control assembly. Chambers 214 and 216 are illustrated as flow lines in FIG. 3A. In the illustrated embodiment, throttle valve 54 comprises a valve spool 210 configured to define portions of two flow channels extending from chamber 200 to chambers 214 and 216 and eventually to the propulsion cylinders. Spool 210 is movable to vary the cross-sectional sizes of such portions of these two flow channels. Throttle valve 54 may be configured so that motion of spool 210 is limited between extreme positions. Spool 210 preferably has a first extreme position in which both flow channels are closed so that fluid is prevented from flowing from chamber 200 to chambers 214 and 216. When spool 210 is in this position, fluid inside chambers 214 and 216 is free to flow through spool 210 to annulus 140, shown as dotted lines throughout FIG. 3A. Spool 210 preferably also has a second extreme position, shown in the figures, in which the sizes of the above-mentioned portions of both flow channels are maximized so that the flowrates of fluid from chamber 200 to chambers 214 and 216 are also maximized. When spool 210 is between these positions, the flow channel sizes are between zero and maximum. Thus, the fluid flow and, hence, thrust received by the pistons is controllable by moving spool 210 between such first and second positions. In other words, the position of spool 210 is controllable so that the flow channels can have multiple sustainable sizes greater than zero, and, preferably, any size between zero and maximum.

Spool 210 is desirably biased on one end by a spring 212, such as a coil spring, leaf spring, or other biasing means. Spring 212 exerts a spring force onto spool 210, which tends to force the spool to the first extreme position described above. Fluid in chamber 204 exerts a fluid pressure force onto the other end of spool 210, which tends to force the spool to the second position described above. Thus, the spring force from spring 212 is opposed by the pressure force from the fluid in chamber 204. Note that the spring force varies depending upon the position of spool 210. As the spool moves toward its second position, the spring force increases as spring 212 becomes compressed. When the pressure in chamber 204 is below a lower threshold, the spring force exceeds the pressure force, causing spool 210 to occupy its first position. When the pressure in chamber 204 exceeds an upper threshold, the pressure force exceeds the spring force, causing spool 210 to occupy its second position. When the pressure in chamber 204 is between the lower and upper thresholds, the spool occupies a position between the first and second positions, at which the spring force is equal to the pressure force. Thus, the position of spool 210 can preferably be precisely controllable by controlling the pressure of fluid in chamber 204.

Throttle pressure-regulator 70 permits the pressure within chamber 204 to be controlled. Various types of known pressure-regulators can be used. Desirably, however, pressure-regulator 70 comprises a first valve portion 218, a second valve portion 220, a biasing means 222, and a controller 224. Valve portion 220 has a closed position in which it mates with valve portion 218 to prevent fluid from flowing out of chamber 204, and an open position in which it permits fluid to flow out of chamber 204 between valve portions 218 and 220. In the illustrated embodiment, first valve portion 218 comprises a valve seat or orifice in fluid communication with chamber 204, and second valve portion 220 comprises a plug 220 sized and configured to seal the valve seat or orifice. Biasing means 222 exerts a closing force onto second valve portion 220, which tends to maintain valve portion 220 in its closed position. Biasing means 222 preferably comprises a spring, such as a coil spring or leaf spring. A spring is desirable because the force can be correlated with the spring constant to more precisely control the valve. Controller 224 controls the closing force of biasing means 222. In a preferred embodiment, controller 224 comprises a motor configured to control compression or extension of a coil spring type biasing means 222. In one embodiment, the motor is coupled to a leadscrew engaged with a nut, wherein the nut is restrained from rotating. Operation of the motor causes the nut to translate along the leadscrew. Desirably, the coil spring is coupled to the nut, so that the motor controls compression or extension of the spring and, hence, its closing force onto second valve portion 220. Preferably, the motor is configured to be controlled by electronic command signals generated by control box 121 or by logic componentry on the tractor itself.

The fluid pressure inside of chamber 204 depends upon the closing force of biasing means 222 against second valve portion 220. Fluid inside chamber 204 exerts a pressure force against valve portion 220, which opposes the closing force. During operation of tractor 20, fluid continually flows from chamber 200 into chamber 204 through flow-restriction 202. As a result, the pressure inside chamber 204 continually tends to rise. If the pressure rises above a target pressure, the fluid pressure force acting on valve portion 220 exceeds the closing force from biasing means 222, causing valve portion 220 to move to its open position. When valve portion 220 is in its open position, fluid inside chamber 204 exhausts out to annulus 140 by flowing between first and second valve portions 218 and 220. This causes the pressure inside chamber 204 to drop. When the pressure drops below the target pressure, biasing means 222 forces valve portion 220 back to its closed position. Thus, biasing means 222 acts to maintain the pressure inside chamber 204 at the target pressure. Controller 224 is operable to vary the closing force of biasing means 222 and, thus, control the pressure inside chamber 204. As will be appreciated, the pressure within chamber 204 is prevented from exceeding a predetermined pressure by the controller 224 and biasing means 222. As mentioned above, the pressure inside chamber 204 controls the position of spool 210 and, hence, the fluid flow and thrust received by pistons 34, 36, 38, and 40.

During forward motion (left to right in FIG. 3A) of tractor 20, fluid in chamber 214 provides thrust for the power strokes of pistons 34, 36, 38, and 40. Thus, fluid in chamber 214 flows to chambers 80 and 84 when aft gripper 42 is actuated, and to chambers 88 and 92 when forward gripper 52 is actuated. Fluid in chamber 216 provides power for the reset strokes of the propulsion cylinders. Fluid in chamber 216 flows to chambers 82 and 86 when aft gripper 42 is retracted, and to chambers 90 and 94 when forward gripper 52 is retracted. Thus, during forward motion, fluid in chamber 214 provides power for thrust, and fluid in chamber 216 provides power for reset.

The opposite is true for backward motion (right to left in FIG. 3A) of tractor 20. During backward motion, fluid in chamber 214 provides power for the reset strokes of the propulsion cylinders. Thus, fluid in chamber 214 flows to chambers 80 and 84 when aft gripper 42 is retracted, and to chambers 88 and 92 when forward gripper 52 is retracted. Fluid in chamber 216 provides thrust for the power strokes of the pistons. Fluid in chamber 216 flows to chambers 82 and 86 when aft gripper 42 is actuated, and to chambers 90 and 94 when forward gripper 52 is actuated. Thus, during backward motion, fluid in chamber 214 provides power for reset, and fluid in chamber 216 provides power for thrust.

Preferably, throttle valve 54 is configured to provide a variable-size orifice between chambers 200 and 214, indicated in the figures by a flow line with a superimposed X (reference numeral 203), as will be understood by those skilled in the art. During forward motion, the variable-size orifice 203 advantageously permits finer control over the flowrate in chamber 214 and, hence, the speed of tractor 20. Such finer control over speed is particularly useful for operations such as milling, drilling, tagging bottom, etc. In the illustrated embodiment, throttle valve 54 does not include a variable size orifice between chambers 200 and 216. Hence, the speed at which the propulsion cylinders reset cannot be as finely controlled. However, the cylinder reset speed is not as critical as the piston speed controlled by orifice 203. During backward motion, orifice 203 permits regulation of cylinder reset speed, but there is no way to more finely control tractor speed. Thus, the tractor will tend to move backward at high speeds. However, backward motion will be used primarily for walking back out of a hole. It is believed that precise control of speed is not critical for backward motion. In an alternative embodiment, throttle valve 54 may be configured to also have a variable-size orifice between chambers 200 and 216, so that speed can be more finely controlled in either direction.

Throttle valve 54 advantageously provides a failsafe mode to stop the tractor. When the fluid pressure in passage 96 is lowered below a threshold, valve 56 closes to cut off fluid supply to the propulsion cylinders and grippers. Thus, by limiting fluid pressure in passage 96, tractor 20 can easily be disengaged from the borehole to facilitate removal of the tractor from the borehole.

Propulsion-control valve 56 controls the distribution of fluid to the propulsion cylinders so that aft cylinders 44 and 46 execute a power stroke while forward cylinders 48 and 50 execute a reset stroke, and vice-versa. Valve 56 preferably comprises a 6way valve spool 57. In various positions, spool 57 permits fluid flow from and between chambers 214, 216, 226, 228, 230, and 232 (shown as flow lines in FIG. 3A), and annulus 140 (shown as dotted lines). Chamber 226 is in fluid communication with aft chambers 80 and 84 of cylinders 44 and 46, respectively. Chamber 228 is in fluid communication with aft chambers 88 and 92 of cylinders 48 and 50, respectively. Chamber 230 is in fluid communication with forward load-control valve 68. Chamber 232 is in fluid communication with aft load-control valve 66.

In operation, propulsion-control valve spool 57 has two positions. In a first position, shown in FIG. 3A, spool 57 causes pistons 34 and 36 to execute a power stroke, and simultaneously causes cylinders 48 and 50 to execute a reset stroke. When spool 57 is in this position, chamber 214 is in fluid communication with chamber 226, chamber 216 is in fluid communication with chamber 230, and chambers 228 and 232 are in fluid communication with annulus 140. High-pressure fluid in chamber 214 flows to rear chambers 80 and 84 of cylinders 44 and 46, tending to cause pistons 34 and 36 to execute a power stroke. Fluid displaced from forward chambers 82 and 86 can flow through aft load-control valve 66 (described below) and chamber 232 out to annulus 140. Also, high-pressure fluid in chamber 216 flows through forward load-control valve 68 (described below) to forward chambers 90 and 94 of cylinders 48 and 50, causing cylinders 48 and 50 to execute a reset stroke. Fluid displaced from rear chambers 88 and 92 flows through chamber 228 out to annulus 140.

In a second position, propulsion-control valve spool 57 causes pistons 38 and 40 to execute a power stroke, and simultaneously causes cylinders 44 and 46 to execute a reset stroke. When spool 57 is in this position, chamber 214 is in fluid communication with chamber 228, chamber 216 is in fluid communication with chamber 232, and chambers 226 and 230 are in fluid communication with annulus 140. High-pressure fluid in chamber 214 flows to rear chambers 88 and 92 of cylinders 48 and 50, tending to cause pistons 38 and 40 to execute a power stroke. Fluid displaced from forward chambers 90 and 94 can flow through forward load-control valve 68 and chamber 230 out to annulus 140. Also, high-pressure fluid in chamber 216 flows through aft load-control valve 66 to forward chambers 82 and 86 of cylinders 44 and 46, causing cylinders 44 and 46 to execute a reset stroke. Fluid displaced from rear chambers 80 and 84 flows through chamber 226 out to annulus 140.

Load-control valves 66 and 68 are configured to impede the power strokes of the pistons. Each load-control valve is preferably configured to generate a fluid pressure force that opposes forward movement of the pistons within the propulsion cylinders. Moreover, the fluid pressure force is desirably controllable to at least partially control the position and speed of the pistons relative to the gripper and, when the gripper is actuated, the borehole. More preferably, each load-control valve is configured to prevent fluid on the forward side of the pistons from being displaced by the pistons when the fluid is below a threshold pressure. Desirably, the particular threshold pressure can be controllably varied by, for example, a pressure-regulator.

In the illustrated embodiment, load-control valves 66 and 68 are identical. Thus, it is not necessary to herein describe both valves 66 and 68 in detail. Therefore, only valve 66 is described in detail herein. With reference to FIGS. 3A and 3C, valve 66 comprises check valves 234 and 236, which are in fluid communication with forward chambers 82 and 86 of propulsion cylinders 44 and 46 via a chamber 238. Check valve 234 comprises flow-restrictor 240, orifice 242, spring 244, and passage 246. Passage 246 has a first end in fluid communication with chamber 238 and a second end in fluid communication with chamber 208. Flow-restrictor 240 is movable within passage 246 and forms an effectively fluid-tight seal between the first and second ends of passage 246. Flow-restrictor 240 has a first surface exposed to fluid in chamber 238, and a second surface exposed to fluid in chamber 208. The first and second surfaces of flow-restrictor 240 are generally opposing. Orifice 242 is in fluid communication with passage 246. Flow-restrictor 240 has a closed position, shown in FIG. 3A, in which flow-restrictor 240 completely restricts fluid flow through orifice 242, and an open position in which flow-restrictor 240 permits fluid flow through orifice 242.

The first surface of flow-restrictor 240 is configured to receive a fluid pressure force from fluid in chamber 238, which tends to move flow-restrictor 240 to its open position. The second surface of flow-restrictor 240 is configured to receive a fluid pressure force from fluid in chamber 208, which tends to move flow-restrictor 240 to its closed position. Spring 244 exerts a spring force onto flow-restrictor 240, which tends to maintain flow-restrictor 240 in its closed position. Spring 244 may comprise, for example, a coil spring, leaf spring, or other biasing means, and may be provided on either side of flow-restrictor 240. In the illustrated embodiment, spring 244 is a coil spring and is connected to the second surface of flow-restrictor 240. Thus, flow-restrictor 240 opens to permit flow through orifice 242 when the fluid pressure force from the fluid in chamber 238 exceeds the fluid pressure force from the fluid in chamber 208 plus the spring force from spring 244. Preferably, the fluid pressure inside chamber 208, and hence the pressure force acting on flow-restrictor 240 from the fluid in chamber 208, can be controlled by load-control pressure-regulator 74, which is desirably identical to load-control pressure-regulator 70. In another embodiment, spring 244 may be omitted from check valve 234.

Preferably, check valve 236 is configured similarly to check valve 234. In the illustrated embodiment, valve 236 has a flow-restrictor 250, orifice 252, spring 254, and passage 256 which are identical to flow-restrictor 240, orifice 242, spring 244, and passage 246, respectively, of valve 234. Chamber 232 is in fluid communication with the first surface of flow-restrictor 250, and chamber 238 is in fluid communication with the second surface of flow-restrictor 250. When pistons 34 and 36 are moving forward to displace fluid in forward chambers 82 and 86 of cylinders 44 and 46, flow-restrictor 250 is maintained in its closed position by the pressure force acting on the second surface of flow-restrictor 250 from the fluid in chamber 238. Spring 254 also tends to maintain flow-restrictor 250 in its closed position, so that fluid cannot flow through orifice 252 and must therefore flow through check valve 234, as described above. In another embodiment, spring 254 may be omitted from check valve 236.

Load-control valve 68 comprises check valves 260 and 262, which are preferably configured identically to check valves 234 and 236.

Gripper-control valve 62 controls the actuation and retraction of grippers 42 and 52. In the illustrated embodiment, valve 62 comprises a valve spool 63 in fluid communication with chambers 216, 264, and 266, and annulus 140 (shown as dotted lines). Chamber 264 extends to aft gripper 42, and chamber 266 extends to forward gripper 52. Spool 63 has a first position (shown in FIG. 3A) in which high-pressure fluid in chamber 216 is permitted to flow into and inflate aft gripper 42, and in which fluid in forward gripper 52 is permitted to flow to annulus 140, causing forward gripper 52 to deflate. Specifically, when spool 63 is in this first position, chamber 216 is in fluid communication with chamber 264, and chamber 266 is in fluid communication with annulus 140. Spool 63 also has a second position in which high-pressure fluid in chamber 216 is permitted to flow into and inflate forward gripper 52, and in which fluid in aft gripper 42 is permitted to flow to annulus 140, causing aft gripper 42 to deflate. Specifically, when spool 63 is in this second position, chamber 216 is in fluid communication with chamber 266, and chamber 264 is in fluid communication with annulus 140.

Spool 63 has a first end 65 exposed to a fluid chamber 282, and a second end 67 exposed to a fluid chamber 274. The fluid pressures inside of chambers 282 and 274 control the position of spool 63. When the pressure inside chamber 282 exceeds the pressure inside chamber 274, the pressure force on first end 65 exceeds that on second end 67. This causes spool 63 to shuttle to its second position, in which chamber 216 is in fluid communication with chamber 266. When the pressure inside chamber 274 exceeds the pressure inside chamber 282, the pressure force on second end 67 exceeds that on first end 65. This causes spool 63 to shuttle to its first position, in which chamber 216 is in fluid communication with chamber 264.

At times it may desirable for tractor 20 to move at a relatively high speed. Faster walking speeds can be facilitated by minimizing gripper deflation. For example, when aft gripper 42 is deflated to permit a reset stroke of propulsion cylinders 44 and 46, it is desirable to deflate gripper 42 only slightly, so that it can be more quickly inflated for a subsequent power stroke of pistons 34 and 36. The same is true for forward gripper 42. Advantageously, faster actuation of the grippers allows the tractor to move faster. Thus, spool 63 desirably includes variable-size orifices 29 and 31, which permit relatively finer control of the deflation of the grippers. Variable size orifices 29 and 31 also permit the deflation rates to be minimized. This provides increased control in that it helps prevent the tractor from losing its grip on the borehole when switching between grippers. In other words, when a first gripper switches from its inflated state to its deflated state and a second gripper simultaneously switches from its deflated state to its inflated state, the deflation rate of the first gripper can be limited to ensure that the second gripper is actuated to grip the borehole before the first gripper releases the borehole.

Figure 5:
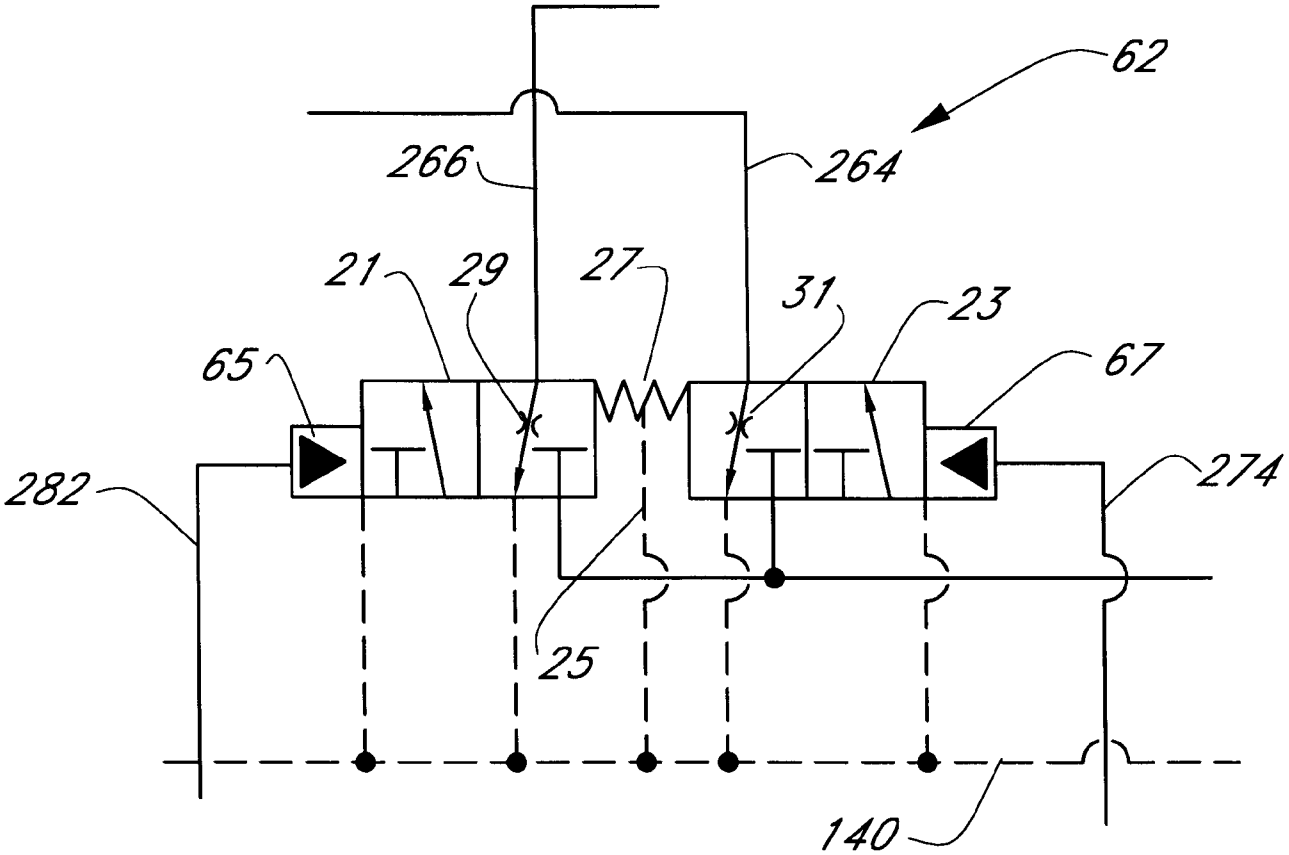
FIG. 5 is a schematic view of an alternative embodiment of the gripper control valve of FIG. 3A.

FIG. 5 is a schematic configuration of an alternative embodiment of a gripper control valve 62. In FIG. 5, valve 62 comprises valve spools 21 and 23 and a biasing means, such as a spring 27. Spring 27 acts to bias spools 21 and 23 away from each other. Preferably, spools 21 and 23 are constrained at ends 65 and 67 so that the spools cannot extend beyond a maximum separation distance. Preferably, spring 27 resides in a chamber which is in fluid communication with annulus 140 via chamber 25. Thus, spools 21 and 23 are biased apart by the biasing force of spring 27 and by the pressure force from fluid in chamber 25, which is at the same pressure as annulus 140. Chamber 25 is provided so that the movement of spools 21 and 23 is not affected by changes in the depth of tractor 20. As the depth changes, so does the pressure in flow channel 96 and, hence, in chambers 274 and 282 which actuate spools 21 and 23. In particular, at greater depths, the pressure in chambers 274 and 282 increases. Since the pressure in annulus 140 also varies with depth, chamber 25 compensates for increased pressure in chambers 274 and 282, so that the motion of spools 21 and 23 is substantially unaffected by the depth of the tractor.

Referring again to FIG. 3A, reverser valve 64 controls the direction of travel of tractor 20. In the illustrated embodiment, valve 64 comprises an 8-way valve spool 61. Spool 61 is in fluid communication with above-described fluid chambers 226, 228, 230, and 232. Spool 61 is also in fluid communication with fluid chambers 272, 274, 276, 278, 280, and 282. Chambers 272 and 278 extend to aft cycle valve 58 (described below). Chambers 276 and 280 extend to forward cycle valve 60 (described below). Chambers 282 and 274 extend to the first end 65 and the second end 67, respectively, of gripper control valve spool 63. In a first position (shown in FIG. 3A), reverser valve spool 61 permits fluid communication between chambers 226 and 272, between chambers 226 and 274, between chambers 232 and 278, between chambers 228 and 280, between chambers 228 and 282, and between chambers 230 and 276. In a second position, reverser valve spool 61 permits fluid communication between chambers 226 and 276, between chambers 232 and 274, between chambers 232 and 280, between chambers 228 and 278, between chambers 230 and 282, and between chambers 230 and 272.

As described below, the position of reverser valve spool 61 controls the direction of travel of tractor 20. Desirably, the position of spool 61 can be controlled by reverser pilot valve 72. In the illustrated embodiment, spool 61 is biased toward its second position by a spring 59, which may be a coil spring, leaf spring, or other biasing means. One end of spool 61 is exposed to fluid in chamber 210. The fluid in chamber 210 exerts a pressure force onto spool 61, which opposes the spring force. When the fluid pressure inside chamber 210 exceeds an upper threshold pressure, spool 61 shuttles to its first position (FIG. 3A). When the fluid pressure inside chamber 210 is below a lower threshold pressure, spool 61 shuttles to its second position. Reverser pilot valve 72 comprises a valve spool 73 having a first position (shown in FIG. 3A) in which spool 73 permits high-pressure fluid in chamber 200 to flow into chamber 210, and a second position in which spool 73 permits fluid in chamber 210 to flow out to annulus 140. When spool 73 occupies its first position, the pressure force on reverser valve spool 61 exceeds the spring force, causing spool 61 to shuttle to its first position. When spool 73 occupies its second position, the pressure force on spool 61 is below the spring force, causing spool 61 to shuttle to its second position. Thus, control of the position of spool 73 controls the position of spool 61. Preferably, a controller 75, such as a motor, controls the position of spool 73, via a leadscrew-nut assembly as described above. More preferably, controller 75 is configured to be controlled by electronic command signals.

Cycle valves 58 and 60 control the sequencing of propulsion-control valve 56. As described above, valve spool 57 slides back and forth between two operational positions. Spool 57 has a first end 268 and a second end 270. Fluid pressure acting on ends 268 and 270 controls the position of spool 57. When the pressure acting on first end 268 exceeds the pressure acting on second end 270, spool 57 shuttles to its first position (shown in FIG. 3A). Conversely, when the pressure acting on second end 270 exceeds the pressure acting on first end 268, spool 57 shuttles to its second position.

Aft cycle valve 58 controls which fluid chamber is exposed to second end 270 of propulsion-control valve spool 57, and forward cycle valve 60 controls which fluid chamber is exposed to first end 268. Aft cycle valve 58 comprises a valve spool 33, which is in fluid communication with first end 268, high-pressure chamber 216, and chamber 278. In a first position (shown in FIG. 3A), spool 33 permits fluid communication between chamber 278 and second end 270. In a second position, spool 33 permits fluid communication between high-pressure chamber 216 and second end 270. Forward cycle valve 60 comprises a valve spool 35, which is in fluid communication with high-pressure chamber 216 and chamber 276. In a first position (shown in FIG. 3A), spool 35 permits fluid communication between chamber 276 and first end 268. In a second position, spool 35 permits fluid communication between high-pressure chamber 216 and first end 268.

In the illustrated embodiment, spools 33 and 35 are generally colinearly arranged and are biased apart by a biasing means which exerts a biasing force onto the spools. The biasing means biases the spools into their first above-described positions. The biasing means may comprise, for example, a spring 41. Preferably, spools 33 and 35 are constrained at ends 37 and 39 so that the spools cannot extend beyond a maximum separation distance. Spool 33 has an end 37 in fluid communication with chamber 272, and spool 35 has an end 39 in fluid communication with chamber 280. Fluid in chamber 272 exerts a pressure force on end 37 of spool 33, which generally opposes the biasing force of spring 41. If the fluid pressure in chamber 272 is lower than a threshold, the biasing force exceeds the pressure force, causing spool 33 to move to its first position, shown in FIG. 3A. If the fluid pressure in chamber 272 exceeds a threshold, the pressure force exceeds the biasing force, causing spool 33 to move to its second position. Fluid in chamber 280 exerts a pressure force on end 39 of spool 35, which also generally opposes the biasing force of spring 41. If the fluid pressure in chamber 280 is lower than a threshold, the biasing force exceeds the pressure force, causing spool 35 to move to its first position, shown in FIG. 3A. If the fluid pressure in chamber 280 exceeds a threshold, the pressure force exceeds the biasing force, causing spool 35 to move to its second position. In an alternative embodiment, spools 33 and 35 may be biased by separate biasing means.

Effective motion of tractor 20 requires a particular sequencing of the power and reset strokes of the propulsion cylinders and pistons, as well as of the actuation and retraction of the grippers. For example, for forward motion (left to right in FIG. 3A) of tractor 20, it is desirable that aft gripper 42 is actuated when fluid is supplied to aft chambers 80 and 84 of aft cylinders 44 and 46. In other words, gripper 42 is desirably actuated when pistons 34 and 36 execute a power stroke, so that tractor body 22 is propelled forward with respect to the borehole. Control assembly 30 is preferably configured so that fluid is supplied to forward chambers 90 and 94 of forward cylinders during the power stroke of pistons 34 and 36. In other words, cylinders 48 and 50 execute a reset stroke during the power stroke of pistons 34 and 36, so that pistons 38 and 40 are positioned for an ensuing power stroke. In order to execute a proper reset stroke, forward gripper 52 is preferably retracted. After the power stroke of pistons 34 and 36, it is desirable that forward gripper 52 become actuated and then aft gripper 42 thereafter retracted. Then, fluid is desirably supplied to aft chambers 88 and 92 of cylinders 48 and 50 while fluid is simultaneously supplied to forward chambers 82 and 86 of cylinders 44 and 46. In other words, pistons 38 and 40 preferably execute a power stroke while cylinders 44 and 46 execute a simultaneous reset stroke. Then, the cycle is repeated.

Advantageously, the hydraulic circuitry and valves of tractor 20 are configured to provide the above-described sequencing of the power strokes of the pistons, reset strokes of the propulsion cylinders, and actuation and retraction of the grippers. In operation, pressure cyclically builds and drops in the various fluid chambers of control assembly 30. This causes cycle valves 58 and 60 to alternate positions in a manner which in turn causes propulsion control valve 56 to cyclically alternate back and forth between its first and second position. Moreover, the particular configuration shown causes gripper control valve 62 to operate generally in tandem with valve 56 to result in longitudinal motion of tractor 20.

The timing of propulsion control valve 56 significantly affects motion of the tractor. For example, if valve 56 switches positions too quickly, a pair propulsion cylinders may switch to a reset stroke before the power stroke is complete. To prevent propulsion control valve 56 from alternating between its two positions too quickly or slowly, there is desirably provided a means for fine-tuning the operation of cycle valves 58 and 60. In the illustrated embodiment, spring 41 resides in a chamber in fluid communication with chamber 208. The fluid in chamber 208 provides an additional pressure force onto spools 33 and 35, which effectively increases the biasing force of spring 41. Recall that the fluid pressure in 208 can be controlled by pressure-regulator 74. Thus, the pressure in chamber 208 can be controlled to adjust the timing of cycle valves 58 and 60. Advantageously, the use of such pressure compensated load control of the cycle valves allows the tractor to operate within a larger differential pressure range (the differential pressure between passage 96 and annulus 140) compared to the prior art. It is estimated that tractor 20 can operate within a differential pressure range of 100 psid to 2500 psid or more.

Figure 4:
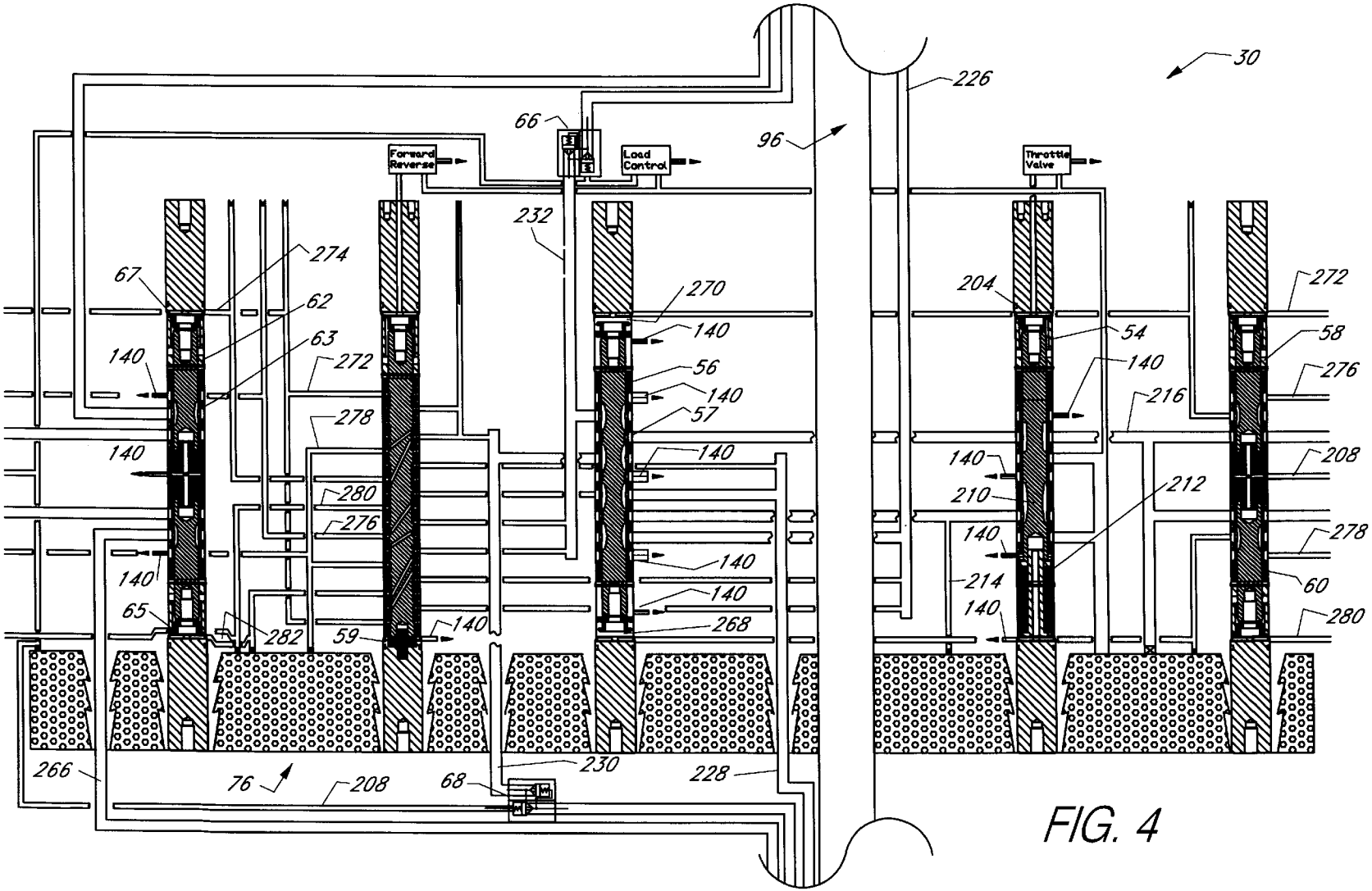
FIG. 4 is a fold-out view of the control assembly of the tractor of the present invention.

FIG. 4 shows the lay-out of one embodiment of control assembly 30 of tractor 20. In this embodiment, assembly 30 is substantially cylindrical. FIG. 4 is a "fold-out" view of control assembly 30, shown as if it were sliced open and unrolled. The top of the figure corresponds to the aft end of assembly 30, and the bottom corresponds to the forward end. The valves and fluid chambers described above are shown.

In a preferred embodiment, the tractor body, propulsion cylinders, and other components of tractor 20 are constructed from flexible materials, such as copper-beryllium, so that the tractor is capable of turning at relatively sharp angles. In operation, localized fluid velocity inside the valves can be very high. Certain fluids, such as drilling fluids and muds, can cause the valves to erode. Thus, the valves are preferably formed from a relatively erosion-resistant material, such as tungsten carbide. In some embodiments, tractor 20 may include magnetic position sensors for sensing the position of the pistons relative to the grippers. In this case, the tractor is preferably formed from non-magnetic materials which do not disturb sensor performance. Acceptable non-magnetic materials include copper-beryllium, Staballoy, stainless steels, etc. The use of rubber seals on the valves as well as recessed internal regions of the valve housings that prevent seal damage during installation, increases reliability by reducing the tendency to cut seals and to promote cross-seal erosion.

If desired, motors of pressure-regulators 70 and 74 can be replaced by electrically operated solenoids. However, motors are preferred because they permit finer control over the fluid pressures which are intended to be controlled and, hence, the valve positions.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications thereof. Thus, it is intended that the scope of the present invention herein disclosed should not be limited by the particular disclosed embodiments described above, but should be determined only by a fair reading of the claims that follow.

What is claimed is:

1. A tractor for moving within a borehole, comprising:

an elongated body having a thrust-receiving portion;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

a flow channel extending to said thrust-receiving portion and configured to contain a first fluid flowing to said thrust-receiving portion;

a chamber configured to contain a second fluid; and a pressure-regulator configured to control the pressure of said second fluid in said chamber;

wherein said tractor is configured such that the pressure of said second fluid in said chamber controls the flowrate of said first fluid in said flow channel flowing to said thrust-receiving portion.

2. The tractor of claim 1, said pressure-regulator comprising:

a first valve portion; and a second valve portion having a closed position in which said second valve portion mates with said first valve portion to prevent said second fluid from flowing out of said chamber, said second valve portion having an open position in which said second valve portion permits said second fluid to flow out of said chamber between said first valve portion and said second valve portion;

wherein said second valve portion is biased to said closed position by a closing force, said closing force being controllable to control the pressure of said second fluid inside said chamber.

3. The tractor of claim 2, said pressure-regulator further comprising a biasing means providing said closing force.

4. The tractor of claim 2, wherein said first valve portion comprises an orifice in fluid communication with said chamber, said second valve portion comprising a plug.

5. The tractor of claim 1, said pressure-regulator comprising:

an orifice in fluid communication with said chamber;

a plug having a closed position in which said plug seals said orifice to contain said second fluid within said chamber, and an open position in which said plug permits said second fluid to flow out of said chamber through said orifice, said plug configured to receive a pressure force from said second fluid in said chamber, said pressure force tending to force said plug to said open position;

a spring exerting a closing force onto said plug which tends to maintain said plug in said closed position; and a motor configured to control at least one of compression and extension of said spring so as to control said closing force;

wherein said motor is controllable to control the pressure of said second fluid in said chamber.

6. The tractor of claim 1, said gripper being inflatable to move to said actuated position and deflatable to move to said retracted position, said tractor further comprising a gripper control valve configured to define a first flow orifice and a second flow orifice, said gripper control valve having a first position in which fluid is configured to flow through said first flow orifice to said gripper to inflate said gripper to said actuated position, and a second position in which fluid is configured to flow from said gripper through said second flow orifice to deflate said gripper to said retracted position, said gripper control valve configured to vary the size of said second flow orifice.

7. The tractor of claim 1, wherein said body is formed at least partially from copper-beryllium.

8. The tractor of claim 7, wherein said gripper control valve is formed at least partially from tungsten carbide.

9. A tractor for moving within a borehole, comprising:

an elongated body having a thrust-receiving portion;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface; and a flow channel extending to said thrust-receiving portion and configured to contain a first fluid flowing to said thrust-receiving portion;

wherein the size of a portion of said flow channel can be altered to control the thrust received by said thrust-receiving portion from said first fluid.

10. The tractor of claim 9, further comprising a first valve movable to vary the size of said portion of said flow channel, wherein the thrust received by said thrust-receiving portion is controllable by moving said first valve.

11. The tractor of claim 10, wherein said first valve is formed at least partially from tungsten carbide.

12. The tractor of claim 10, said first valve having a first position in which said flow channel is closed, and a second position in which said portion of said flow channel has a maximum size, said valve being movable so that said flow channel can have multiple sustainable sizes greater than zero.

13. The tractor of claim 12, further comprising:

a first spring exerting a spring force onto said first valve, said spring force tending to push said first valve to said first position, said spring force increasing as said first valve moves toward said second position; and a chamber configured to contain a second fluid, said first valve in fluid communication with said chamber so that said first valve is configured to receive a first pressure force from said second fluid, said first pressure force tending to force said first valve toward said second position;

wherein the position of said first valve is controllable by controlling the pressure of said second fluid in said chamber.

14. The tractor of claim 13, further comprising a second valve configured to control the pressure of said second fluid, said second valve comprising:

an orifice in fluid communication with said chamber;

a plug having a closed position in which said plug seals said orifice to contain said second fluid within said chamber, and an open position in which said plug permits said second fluid to flow out of said chamber through said orifice, said plug configured to receive a second pressure force from said second fluid, said second pressure force tending to force said plug to said open position;

a second spring exerting a closing force onto said plug which tends to maintain said plug in said closed position; and a motor configured to control at least one of compression and extension of said spring so as to control said closing force;

wherein said motor is controllable to control the pressure of said second fluid in said chamber.

15. The tractor of claim 13, further comprising a second valve configured to control the pressure of said second fluid, said second valve comprising:

a first valve portion; and a second valve portion having a closed position in which said second valve portion mates with said first valve portion to prevent said second fluid from flowing out of said chamber, said second valve portion having an open position in which said second valve portion permits said second fluid to flow out of said chamber between said first valve portion and said second valve portion;

wherein said second valve portion is biased to said closed position by a closing force, said closing force being controllable to control the pressure of said second fluid inside said chamber.

16. The tractor of claim 15, said second valve further comprising a biasing means providing said closing force.

17. The tractor of claim 15, wherein said first valve portion comprises an orifice in fluid communication with said chamber, said second valve portion comprising a plug.

18. The tractor of claim 9, wherein said body is formed from copper-beryllium.

19. A tractor for moving within a borehole, comprising:

an elongated body having a thrust-receiving portion; and a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

wherein said tractor is configured such that longitudinal movement of said thrust-receiving portion in a first direction relative to said gripper can be opposed by a fluid pressure force, said fluid pressure force being controllable to at least partially control the position and speed of said thrust-receiving portion relative to said gripper.

20. A tractor for moving within a borehole, comprising:

an elongated body having a thrust-receiving portion;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

a container longitudinally fixed with respect to said gripper and longitudinally movable with respect to said body, said container containing said thrust-receiving portion; and a first valve configured to prevent a first fluid on a first side of said thrust-receiving portion from being displaced by said thrust-receiving portion when said first fluid is below a threshold pressure.

21. The tractor of claim 20, wherein one or more of said body and container is formed at least partially from copper-beryllium.

22. The tractor of claim 20, wherein said first valve is formed at least partially from tungsten carbide.

23. The tractor of claim 20, wherein said threshold pressure can be varied.

24. The tractor of claim 20, further comprising a second valve configured to regulate the pressure of a second fluid exerting a pressure force on said first valve, wherein said threshold pressure can be controlled by controlling said second valve.

25. The tractor of claim 20, further comprising:

a chamber configured to contain a second fluid; and a pressure-regulator controllable to control the pressure of said second fluid in said chamber;

wherein said first valve comprises:

a first orifice configured to be in fluid communication with said container; and a flow-restrictor having a first surface in fluid communication with said first side of said thrust-receiving portion and a second surface in fluid communication with said chamber, said second surface generally opposing said first surface, said flow-restrictor having a closed position in which said flow-restrictor completely restricts fluid flow through said first orifice, and an open position in which said flow-restrictor permits fluid flow through said first orifice, said first surface of said flow-restrictor configured to receive a first pressure force from said first fluid, said first pressure force tending to move said flow-restrictor to said open position, said second surface of said flow-restrictor configured to receive a second pressure force from said second fluid, said second pressure force tending to move said flow-restrictor to said closed position.

26. The tractor of claim 25, said first valve further comprising a first spring exerting a spring force on said flow-restrictor which tends to oppose movement of said flow-restrictor toward said open position, wherein said flow-restrictor moves toward said open position when said first pressure force exceeds the sum of said spring force and said second pressure force.

27. The tractor of claim 26, said first spring comprising a coil spring.

28. The tractor of claim 25, wherein said flow-restrictor is biased toward said closed position by a biasing force, said flow-restrictor being configured to move toward said open position when said first pressure force exceeds the sum of said biasing force and said second pressure force.

29. The tractor of claim 28, said first valve further comprising a biasing means providing said biasing force.

30. The tractor of claim 25, said pressure-regulator comprising:

a second orifice in fluid communication with said chamber;

a plug having a closed position in which said plug prevents said second fluid from flowing out of said chamber through said second orifice, and an open position in which said plug permits said second fluid to flow out of said chamber through said second orifice; and a spring exerting a closing force onto said plug which tends to maintain said plug in said closed position thereof;

wherein said closing force is controllable to control the pressure of said second fluid inside said chamber.

31. The tractor of claim 30, said second valve further comprising a motor controlling one of compression or extension of said spring so as to control said closing force, said motor configured to be controlled by electronic command signals.

32. The tractor of claim 30, said spring comprising a coil spring.

33. The tractor of claim 25, said pressure-regulator comprising:

a first valve portion; and a second valve portion having a closed position in which said second valve portion mates with said first valve portion to prevent said second fluid from flowing out of said chamber, said second valve portion having an open position in which said second valve portion permits said second fluid to flow out of said chamber between said first valve portion and said second valve portion;

wherein said second valve portion is biased to said closed position by a closing force, said closing force being controllable to control the pressure of said second fluid inside said chamber.

34. The tractor of claim 33, said pressure-regulator further comprising a biasing means providing said closing force.

35. The tractor of claim 33, said pressure-regulator further comprising a motor configured to control said closing force, said motor configured to be controlled by electronic command signals.

36. The tractor of claim 33, wherein said first valve portion comprises a second orifice in fluid communication with said chamber, said second valve portion comprising a plug.

37. A tractor for moving within a borehole, comprising:

an elongated body having a thrust-receiving portion, said thrust-receiving portion having a first surface configured to receive hydraulic thrust to propel said body in a first longitudinal direction, and a second surface configured to receive hydraulic thrust to propel said body in a second longitudinal direction generally opposite said first direction;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

a fluid distribution system configured to provide hydraulic thrust to said first and second surfaces;

a reverser valve having a first position in which said distribution system provides hydraulic thrust to said first surface, and a second position in which said distribution system provides hydraulic thrust to said second surface, said reverser valve being formed at least partially by tungsten carbide; and a motor configured to control the position of said reverser valve.

38. A tractor for moving within a borehole, comprising:

an elongated body having a thrust-receiving portion, said thrust-receiving portion having a first surface configured to receive hydraulic thrust to propel said body in a first longitudinal direction, and a second surface configured to receive hydraulic thrust to propel said body in a second longitudinal direction generally opposite said first direction;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

a fluid distribution system configured to provide hydraulic thrust to said first and second surfaces;

a reverser valve having a first position in which said distribution system provides hydraulic thrust to said first surface, and a second position in which said distribution system provides hydraulic thrust to said second surface, said reverser valve being biased into said first position;

a motor configured to control the position of said reverser valve;

a chamber in fluid communication with a surface of said reverser valve, said chamber configured to contain a first fluid; and a pressure-regulator configured to control the pressure of said first fluid in said chamber;

wherein the pressure of said first fluid opposes the bias of said reverser valve, said motor controlling said pressure-regulator.

39. The tractor of claim 38, said pressure-regulator comprising a pilot valve having a first position in which said pilot valve is configured to permit higher pressure fluid into said chamber, said higher pressure fluid configured to exert a pressure force onto said surface of said reverser valve to push said reverser valve to said second position of said reverser valve, and a second position in which said pilot valve permits said first fluid to flow out of said chamber so that said bias maintains said reverser valve in said first position, said motor controlling the position of said pilot valve.

40. The tractor of claim 39, wherein said motor is configured to be controlled by electronic command signals.

41. A tractor for moving within a borehole, comprising:

an elongated body having first and second thrust-receiving portions on an outer surface of said body;

a first gripper longitudinally movably engaged with said body, said first gripper having an actuated position in which said first gripper limits relative movement between said first gripper and an inner surface of said borehole, and a retracted position in which said first gripper permits substantially free relative movement between said first gripper and said inner surface;

a second gripper longitudinally movably engaged with said body, said second gripper having an actuated position in which said second gripper limits relative movement between said second gripper and said inner surface, and a retracted position in which said second gripper permits substantially free relative movement between said second gripper and said inner surface;

a first elongated container longitudinally movably engaged on said body and longitudinally fixed with respect to said first gripper, said first container defining a first elongated space between said first container and said body, said first container enclosing said first thrust-receiving portion such that said first thrust-receiving portion fluidly divides said first space into a first chamber and a second chamber;

a second elongated container longitudinally movably engaged on said body and longitudinally fixed with respect to said second gripper, said second container defining a second elongated space between said second container and said body, said second container enclosing said second thrust-receiving portion such that said second thrust-receiving portion fluidly divides said second space into a third chamber and a fourth chamber;

fluid distribution system configured to distribute fluid to said first, second, third, and fourth chambers to propel said body longitudinally;

a reverser valve configured to control the direction of said tractor, said reverser valve having a first position in which said tractor moves in a first longitudinal direction according to a first cycle of steps comprising:

actuating said first gripper;

retracting said second gripper;

supplying fluid to said first chamber to propel said body in said first direction;

supplying fluid to said fourth chamber to propel said second container in said first direction, said second container being propelled with respect to said body;

actuating said second gripper;

retracting said first gripper;

supplying fluid to said third chamber to propel said body in said first direction; and supplying fluid to said second chamber to propel said first container in said first direction, said first container being propelled with respect to said body;

said reverser valve having a second position in which said tractor moves in a second longitudinal direction according to a second cycle of steps comprising:

actuating said first gripper;

retracting said second gripper;

supplying fluid to said second chamber to propel said body in said second direction generally opposite said first direction;

supplying fluid to said third chamber to propel said second container in said second direction, said second container being propelled with respect to said body;

actuating said second gripper;

retracting said first gripper;

supplying fluid to said fourth chamber to propel said body in said second direction; and supplying fluid to said first chamber to propel said first container in said first direction, said first container being propelled with respect to said body; and a motor configured to control the position of said reverser valve.

42. The tractor of claim 41, wherein said motor is configured to be controlled by electronic command signals.

43. The tractor of claim 41, further comprising:

a spring biasing said reverser valve in said first position;

a fifth chamber in fluid communication with a first surface of said reverser valve; and a pressure-regulator configured to control the fluid pressure inside of said fifth chamber;

wherein the pressure inside of said fifth chamber controls the position of said reverser valve, said motor controlling said pressure-regulator.

44. The tractor of claim 43, said pressure-regulator comprising a pilot valve having a first position in which said pilot valve is configured to permit higher pressure fluid into said fifth chamber, said higher pressure fluid configured to exert a pressure force onto said first surface of said reverser valve to push said reverser valve to said second position, and a second position in which said pilot valve permits said first fluid to flow out of said chamber so that said spring maintains said reverser valve to said first position, said motor controlling the position of said pilot valve.

45. The tractor of claim 44, wherein said motor is configured to be controlled by electronic command signals.

46. A tractor for moving within a borehole, comprising:

an elongated body having a thrust-receiving portion having a first surface and a second surface generally opposing said first surface;

a gripper longitudinally movably engaged with said body, said gripper having an actuated position in which said gripper limits relative movement between said gripper and an inner surface of said borehole, and a retracted position in which said gripper permits substantially free relative movement between said gripper and said inner surface;

a first valve having a first position in which said first valve directs fluid to said first surface of said thrust-receiving portion, and a second position in which said first valve directs fluid to said second surface of said thrust-receiving portion, said first valve having a first end surface configured to receive a first fluid pressure force acting to push said first valve to said first position of said first valve, said first valve configured to receive a first opposing force opposing said first fluid pressure force;

a first fluid chamber;

a second fluid chamber;

a third fluid chamber;

a fourth fluid chamber; and a second valve having a first position in which said second valve permits fluid communication between said first chamber and said first end surface, and a second position in which said second valve permits fluid communication between said second chamber and said first end surface, said second valve having a second end surface in fluid communication with said third chamber, said second end surface configured to receive a second fluid pressure force acting to push said second valve to said first position of said second valve, said second valve having a third end surface in fluid communication with said fourth chamber, said third end surface configured to receive a third fluid pressure force opposing said second fluid pressure force;

wherein pressure variations in said first, second, and third chambers cause said first and second valves to cycle between their first and second positions, the fluid pressure in said fourth chamber being controllable to control the movement of said second valve.

47. The tractor of claim 46, wherein said second valve is biased to said second position of said second valve by a biasing force.

48. The tractor of claim 47, further comprising a biasing means providing said biasing force.

49. The tractor of claim 46, further comprising a pressure-regulator configured to control the pressure in said fourth chamber, said pressure-regulator being configured to controlled by a motor, said motor being configured to be controlled by electronic command signals.

* * * * *